US010636254B1

(12) United States Patent
Hamman et al.

(10) Patent No.: US 10,636,254 B1
(45) Date of Patent: Apr. 28, 2020

(54) SYSTEM AND METHOD FOR INSTANT WIN SCRATCH OFF TICKET GAME WITH TICKET SALES MAXIMIZATION USING SECONDARY GAME

(71) Applicant: SCA Promotions, Dallas, TX (US)

(72) Inventors: Robert D. Hamman, Dallas, TX (US); Kenneth E. Irwin, Jr., Dawsonville, GA (US); Jay B. Ross, Delran, NJ (US)

(73) Assignee: SCA PROMOTIONS, Dallas, TX (US)

( * ) Notice: Subject to any disclaimer, the term of this patent is extended or adjusted under 35 U.S.C. 154(b) by 0 days.

(21) Appl. No.: 16/558,898

(22) Filed: Sep. 3, 2019

Related U.S. Application Data

(60) Provisional application No. 62/919,389, filed on Mar. 11, 2019.

(51) Int. Cl.

| | |
|---|---|
| ***G07F 17/00*** | (2006.01) |
| ***A63F 3/00*** | (2006.01) |
| ***G07F 19/00*** | (2006.01) |
| ***G07F 17/32*** | (2006.01) |
| ***A63F 3/06*** | (2006.01) |

(52) U.S. Cl.
CPC ..... *G07F 17/329* (2013.01); *A63F 3/06* (2013.01); *G07F 17/3267* (2013.01)

(58) Field of Classification Search
CPC ..... G07F 17/329; A63F 3/06; A63F 3/0645; A63F 3/065
USPC ..... 463/17
See application file for complete search history.

(56) References Cited

U.S. PATENT DOCUMENTS

| | | | | |
|---|---|---|---|---|
| 4,174,857 | A | 11/1979 | Koza | |
| 4,191,376 | A | 3/1980 | Goldman et al. | |
| 4,299,637 | A | 11/1981 | Oberdeck et al. | |
| 4,643,454 | A | 2/1987 | Ondis | |
| 8,579,693 | B2 | 11/2013 | Bennett et al. | |
| 2001/0044336 | A1* | 11/2001 | Reiss | G07F 17/32 463/17 |
| 2003/0116916 | A1* | 6/2003 | Cherry | A63F 3/069 273/292 |
| 2004/0056416 | A1* | 3/2004 | Bennett, III | G07C 15/00 273/269 |
| 2007/0057461 | A1* | 3/2007 | Meyer | A63F 3/06 273/269 |
| 2008/0045299 | A1* | 2/2008 | Bennett, III | G06F 21/64 463/17 |
| 2009/0061992 | A1* | 3/2009 | Boykin | G07F 17/32 463/25 |
| 2009/0186680 | A1* | 7/2009 | Napolitano | G07F 17/32 463/17 |
| 2012/0136465 | A1* | 5/2012 | Guinn | G07F 17/32 700/92 |

(Continued)

*Primary Examiner* — Milap Shah
(74) *Attorney, Agent, or Firm* — Meagher Emmanuel Laks; Goldberg & Liao, LLP

(57) ABSTRACT

According to various embodiments, a system, method, and non-transitory computer-readable medium for increasing the operational lifetime of a lottery game is disclosed. The system, method, and non-transitory computer-readable medium include a game specification having rules for a primary game and a conditional secondary game. The rules include that initial winnings above a predetermined threshold in the primary game allow for entry in the secondary game for a chance to increase the initial winnings.

20 Claims, 31 Drawing Sheets

(56) References Cited

U.S. PATENT DOCUMENTS

| | | | | |
|---|---|---|---|---|
| 2015/0310696 | A1* | 10/2015 | Mound | G07F 17/3267<br>463/17 |
| 2017/0024954 | A1* | 1/2017 | Chhabra | G07F 17/329 |
| 2018/0012453 | A1* | 1/2018 | Anderson | G07F 17/3267 |
| 2018/0068529 | A1* | 3/2018 | Delekta | G07F 17/3209 |

* cited by examiner

| | |
|---|---|
| Size of Print Run | 5,400,000 |
| Pools | 50 |
| Pool Size | 108,000 |
| Cost per ticket | $20.00 |
| Tickets per roll | 15 |
| Total rolls | 360,000 |
| Rolls per pool | 7,200 |
| Maximum # of Secondary Game Upgrades Permitted | 10 |

| | Prize | Total Available | Prize per Pool | Token # |
|---|---|---|---|---|
| Prize Schedule | 1,000,000 | 5 | - | 10 |
| | 100,000 | 5 | - | 9 |
| | 10,000 | 50 | 1 | 8 |
| | 1,000 | 4,300 | 86 | 7 |
| | 500 | 8,100 | 162 | 6 |
| | 200 | 27,450 | 549 | 5 |
| | 100 | 216,000 | 4,320 | 4 |
| | 50 | 360,000 | 7,200 | 3 |
| | 40 | 180,000 | 3,600 | 2 |
| | 20 | 720,000 | 14,400 | 1 |
| | 0 | 3,884,100 | 77,682 | 0 |

Figure 4

Lottery Department
Dog Days of Summer Scratch off Lottery Game 2136

1. Name of the game:
   The name of the game is Dog Days of Summer. The game number is DS-2136.

2. Price of the ticket:
   The price of a Dog Days of Summer instant lottery game ticket is $20.00.

3. Play symbols:
   Each Dog Days of Summer instant lottery game ticket will contain one play area featuring a "WINNING NUMBERS" area and a "YOUR NUMBERS" area. The play symbols and their captions located in the "WINNING NUMBERS" area are: 1 (ONE), 2 (TWO), 3 (THREE), 4 (FOUR), 5 (FIVE), 6 (SIX), 7 (SEVEN), 8 (EIGHT), 9 (NINE), 11 (ELEVN), 12 (TWLV), 13 (THRTN), 14 (FORTN), 15 (FIFTN), 16 (SIXTN), 17 (SVNTN), 18 (EGHTN), 19 (NINTN), 20 (TWENT), 21 (TWYONE), 22 (TWYTWO), 23 (TWYTHR), 24 (TWYFOR), 25 (TWYFIV), 26 (TWYSIX), 27 (TWYSVN), 28 (TWYEGT), 29 (TWYNIN), 30 (THIRTY), 31 (THYONE), 32 (THYTWO), 33 (THYTHR), 34 (THYFOR), 35 (THYFIV), 36 (THYSIX), 37 (THYSVN), 38 (THYEGT), 39 (THYNIN), and 40 (FORTY). The play symbols and their captions located in the "YOUR NUMBERS" area are: 1 (ONE), 2 (TWO), 3 (THREE), 4 (FOUR), 5 (FIVE), 6 (SIX), 7 (SEVEN), 8 (EIGHT), 9 (NINE), 11 (ELEVN), 12 (TWLV), 13 (THRTN), 14 (FORTN), 15 (FIFTN), 16 (SIXTN), 17 (SVNTN), 18 (EGHTN), 19 (NINTN), 20 (TWENT), 21 (TWYONE), 22 (TWYTWO), 23 (TWYTHR), 24 (TWYFOR), 25 (TWYFIV), 26 (TWYSIX), 27 (TWYSVN), 28 (TWYEGT), 29 (TWYNIN), 30 (THIRTY), 31 (THYONE), 32 (THYTWO), 33 (THYTHR), 34 (THYFOR), 35 (THYFIV), 36 (THYSIX), 37 (THYSVN), 38 (THYEGT), 39 (THYNIN), and 40 (FORTY).

4. Prize symbols:
   The prize symbols and their captions located in the "YOUR NUMBERS" area are: $20.00 (TWENTY), $40.00 (FORTY), $50.00 (FIFTY), $100 (ONE HUN), $200 (TWO HUN), $500 (FIV HUN), $1,000 (ONE THO), $10,000 (TEN THO), $100,000 (ONEHUNTHO) and $1MILL (ONE MIL).

5. Prizes:
   The prizes that can be won in this game are: $20, $40, $50, $100, $200, $500, $1,000, $10,000, $100,000 and $1,000,000.

6. Approximate number of tickets printed for the game:
   Approximately 5,400,000 tickets will be printed for the Dog Days of Summer instant game.

7. Determination of prize winners:
   (a) Holders of tickets upon which any one of the "YOUR NUMBERS" play symbols matches any of the "WINNING NUMBERS" play symbols, and a prize symbol of $1MILL (ONE MIL) appears in the "prize" area under the matching "YOUR NUMBERS" play symbol, on a single ticket, shall be entitled to a prize of $1,000,000. This prize shall be paid as a one-time, lump-sum cash payment.

Figure 13(a)

(b) Holders of tickets upon which any one of the "YOUR NUMBERS" play symbols matches any of the "WINNING NUMBERS" play symbols, and a prize symbol of $100,000 (ONEHUNTHO) appears in the "prize" area under the matching "YOUR NUMBERS" play symbol, on a single ticket, shall be entitled to a prize of $100,000.

(c) Holders of tickets upon which any one of the "YOUR NUMBERS" play symbols matches any of the "WINNING NUMBERS" play symbols, and a prize symbol of $10,000 (TEN THO) appears in the "prize" area under the matching "YOUR NUMBERS" play symbol, on a single ticket, shall be entitled to a prize of $10,000.

(d) Holders of tickets upon which any one of the "YOUR NUMBERS" play symbols matches any of the "WINNING NUMBERS" play symbols, and a prize symbol of $1,000 (ONE THO) appears in the "prize" area under the matching "YOUR NUMBERS" play symbol, on a single ticket, shall be entitled to a prize of $1,000.

(e) Holders of tickets upon which any one of the "YOUR NUMBERS" play symbols matches any of the "WINNING NUMBERS" play symbols, and a prize symbol of $500 (FIV HUN) appears in the "prize" area under the matching "YOUR NUMBERS" play symbol, on a single ticket, shall be entitled to a prize of $500.

(f) Holders of tickets upon which any one of the "YOUR NUMBERS" play symbols matches any of the "WINNING NUMBERS" play symbols, and a prize symbol of $200 (TWO HUN) appears in the "prize" area under the matching "YOUR NUMBERS" play symbol, on a single ticket, shall be entitled to a prize of $200.

(g) Holders of tickets upon which any one of the "YOUR NUMBERS" play symbols matches any of the "WINNING NUMBERS" play symbols, and a prize symbol of $100 (ONE HUN) appears in the "prize" area under the matching "YOUR NUMBERS" play symbol, on a single ticket, shall be entitled to a prize of $100.

(h) Holders of tickets upon which any one of the "YOUR NUMBERS" play symbols matches any of the "WINNING NUMBERS" play symbols, and a prize symbol of $50.00 (FIFTY) appears in the "prize" area under the matching "YOUR NUMBERS" play symbol, on a single ticket, shall be entitled to a prize of $50.

(i) Holders of tickets upon which any one of the "YOUR NUMBERS" play symbols matches any of the "WINNING NUMBERS" play symbols, and a prize symbol of $40.00 (FORTY) appears in the "prize" area under the matching "YOUR NUMBERS" play symbol, on a single ticket, shall be entitled to a prize of $40.

(j) Holders of tickets upon which any one of the "YOUR NUMBERS" play symbols matches any of the "WINNING NUMBERS" play symbols, and a prize symbol of $20.00 (TWENTY) appears in the "prize" area under the matching "YOUR NUMBERS" play symbol, on a single ticket, shall be entitled to a prize of $20.

Figure 13(b)

8. Number and description of prizes and approximate odds:

| When Any Of Your Numbers Match Any Winning Number, Win Prize Shown Under The Matching Number. Win With: | Win: | Approximate Odds Are 1 In: | Approximate No. Of Winners Per 5,400,000 Tickets |
|---|---|---|---|
| $20 | $20 | 7.5 | 720,000 |
| $40 | $40 | 30 | 180,000 |
| $50 | $50 | 15 | 360,000 |
| $100 | $100 | 25 | 216,000 |
| $200 | $200 | 196 | 27,450 |
| $500 | $500 | 666 | 8,100 |
| $1,000 | $1,000 | 1,256 | 4,300 |
| $10,000 | $10,000 | 108,000 | 50 |
| $100,000 | $100,000 | 1,080,000 | 5 |
| $1,000,000 | $1,000,000 | 1,080,000 | 5 |

Prizes, including top prizes, are subject to availability at the time of purchase.

9. Conditional Secondary Game:
   (a) Eligibility for Conditional Secondary Game:
      (a) SAME AS 7b
      (b) SAME AS 7c
      (c) SAME AS 7d
   (b) Participation in Secondary Game:
      (a) Ticket holders will contact their local lottery office to schedule appointment for participation in Secondary Game.
      (b) During pre-scheduled visit, the ticket holder shall present ticket for validation. Upon successful validation, the ticket holder will be given one (1) chance to play the Conditional Secondary Game.
      (c) Participation in the Conditional Secondary Game does not forfeit original winning amount shown on the ticket.
   (c) Maximum Conditional Secondary Game winners shall be set at 10.
   (d) Conditional Secondary Game description of prizes and approximate odds:

| Original Winning Amount | Possible Winning Amount | Approximate Odds are 1 in: |
|---|---|---|
| $100,000 | $1,000,000 | 15 |
| $10,000 | $1,000,000 | 150 |
| $1,000 | $1,000,000 | 625 |

Figure 13(c)

10. Retailer incentive awards:
The Lottery may conduct a separate Retailer Incentive Program for retailers who sell Dog Days of Summer instant lottery game tickets.

11. Retailer bonus:
The Lottery may offer a retailer bonus in connection with the sale of instant lottery game tickets. If a retailer bonus is offered, a Lottery retailer shall be eligible for a bonus as described in this section. Lottery retailers who sell a winning ticket that entitles the ticket holder to a prize, either payable in a single installment or having a guaranteed minimum payout, of at least $100,000 and not exceeding $500,000 shall be paid a bonus of $500. Lottery retailers who sell a winning ticket that entitles the ticket holder to a prize, either payable in a single installment or having a guaranteed minimum payout, of at least $500,001 and not exceeding $1,000,000 shall be paid a bonus of $5,000. A Lottery retailer is entitled only to the largest bonus for which they qualify for on a winning ticket. A bonus will be initiated for payment after the instant ticket is claimed and validated. A bonus will not be awarded to a Lottery retailer that sells a non-winning Lottery instant ticket used to enter a Lottery second-chance drawing or promotion that is subsequently selected to win a prize.

12. Unclaimed prize money:
For a period of 1 year from the announced close of Dog Days of Summer, prize money from winning Dog Days of Summer instant lottery game tickets will be retained by the Secretary for payment to the persons entitled thereto. If no claim is made within 1 year of the announced close of the Dog Days of Summer instant lottery game, the right of a ticket holder to claim the prize represented by the ticket, if any, will expire and the prize money will be paid into the State Lottery Fund and used for purposes provided for by statute.

13. Governing law:
In purchasing a ticket, the customer agrees to comply with and abide by the State Lottery Law and the provisions contained in this notice.

14. Termination of the game:
The Lottery may announce a termination date, after which no further tickets from this game may be sold. The announcement will be disseminated through media used to advertise or promote Dog Days of Summer or through normal communications methods.

15. Ticket Redemption
    a. Prizes up to $2,500 may be claimed at an authorized Lottery retailer.
    b. Prizes over $2,500 must be submitted to the Lottery Office with a completed claim form.
    c. Prizes over $600 require winner to file a Claim Form.

Figure 13(d)

| Prize Level | Prize | Probability Coefficient |
|---|---|---|
| 1 | $100,000 | 0.0667 |
| 2 | $10,000 | 0.0067 |
| 3 | $1,000 | 0.0016 |
| 4 | $500 | 0.0 |
| 5 | $200 | 0.0 |
| 6 | $100 | 0.0 |
| 7 | $50 | 0.0 |
| 8 | $40 | 0.0 |
| 9 | $20 | 0.0 |

| Prize Tier | Prize | Probability Coefficient |
|---|---|---|
| 1 | $1,000,000 | 0.1000 |
| 2 | $100,000 | 0.1000 |
| 3 | $25,000 | 0.1667 |
| 4 | $10,000 | 0.6667 |

SYSTEM AND METHOD FOR INSTANT WIN SCRATCH OFF TICKET GAME WITH TICKET SALES MAXIMIZATION USING SECONDARY GAME

CROSS-REFERENCE TO RELATED APPLICATIONS

This application claims priority to provisional application 62/919,389, filed Mar. 11, 2019, which is herein incorporated by reference in its entirety.

FIELD OF THE INVENTION

The present invention relates generally to public lottery games and, more particularly, to extending the play lifetime of an instant win scratch off ticket game of chance by including a conditional prize win feature.

BACKGROUND OF THE INVENTION

During the 1960s, grocery stores and gas stations handed out free game cards covered with a waxy coating that hid a possible prize. The prizes tended to be small, often worth only a penny. There were also free cards that could be compared to supermarket ads in newspapers in a manner similar to the game Bingo: If a card matched the graphic symbols in print, the consumer could win food, money, or prizes. These simple participant games evolved into what today is now referred to as instant win games, where a participant can potentially win a large sum of money playing a game of chance.

The first secure instant lottery ticket was developed in 1974 by scientist John Koza and retail promotions specialist Daniel Bower. Koza and Bower were the cofounders of Scientific Games in Las Vegas, Nev. This was the beginning of the instant lottery concept. When secure instant lottery tickets debuted in May 1974, players in Massachusetts had been buying roughly $1,000,000 worth of six-digit lotto drawing tickets every week. By the end of the first seven days of marketing instant-win cards, the state had sold $2,700,000 worth of them.

U.S. Pat. No. 4,174,857 (Koza), issued Nov. 20, 1979, provides evidence of a game ticket particularly useful as an instant win ticket. The ticket comprises at least a base sheet and a cover sheet which are adhesively joined together in a peripheral portion. Information to be concealed is placed on the surface of the base sheet which faces the cover sheet. This information is concealed by covering it with a suitable, removable material which is opaque, thus concealing the information until the opaque material is removed.

U.S. Pat. No. 4,191,376 (Goldman et al), issued Mar. 4, 1980, provides for an instant lottery ticket imprinted with lottery numbers and serial numbers that are uniquely related. Lottery numbers are covered from view until after purchase. This provides for control and distribution of winners with a high degree of security. Computerized fabrication allows for high security and low-cost production.

U.S. Pat. No. 4,299,637 (Oberdeck et al), issued Nov. 10, 1981, discloses a method for making a game ticket which has a base sheet adhesively joined together in peripheral portions of sections containing information used in the game. An opaque material is applied over the release coating to conceal information in the printed areas. The opaque material is adapted to be rubbed off when the ticket is used.

U.S. Pat. No. 4,643,454 (Ondis), issued Feb. 17, 1987 and assigned to Astro-Med Inc., provides an instant game type lottery ticket having a coating on the front side which includes a first metallic layer and an outwardly facing layer of thermally responsive chemicals, a removable opaque layer over at least a portion of the thermally responsive chemical layer, and a second metallic layer on the back side of the ticket. The metallic layers include vacuum deposited silver-colored metallized layers having protective transparent plastic films thereon. Game-playing indicia can be imprinted on the lottery ticket at the point of sale without damaging the removable opaque layer by selectively activating the thermally responsive chemicals under the removable opaque layer with a thermal printhead. The transparent plastic films allow the ticket to be thermally imprinted with a thermal printhead without damaging the printhead and the metallized layers adding opacity to the lottery ticket.

U.S. Pat. No. 8,579,693 (Bennett), issued Nov. 12, 2013, discloses a system and method for providing an additional or end of game drawing to players of a lottery game. A player participates in a lottery and subsequently submits a validation code from his ticket to a lottery ticket provider. The lottery ticket provider then applies an algorithm to the validation code to determine if the player is entered into a secondary game or end of game drawing.

Approximately 43 US states and territories currently offer a lottery with a scratch off ticket available for purchase. Scratch off tickets significantly increase lottery revenue when they are utilized. A limitation to existing scratch off ticket games is that when the grand prizes associated with a specific game or series of tickets are exhausted the sales of the remaining tickets of that specific game are terminated. With increasing grand prize amounts and quantities awarded, the Lottery risks a deficit or a significant revenue shortfall if all of the grand prizes are awarded before a "critical point" in sales has occurred.

As an example, consider a scratch off lottery game with the following specifications:

1) A print run 5,400,000 divided into 50 pools and 360,000 rolls of tickets.

2) Each pool contains 108,000 tickets divided across 7200 rolls with 15 tickets per roll.

3) Each ticket costs $20.00.

4) Five grand prize-winning tickets seeded uniformly and randomly across the 50 pools amount of $1,000,000 each.

The Grand Prize tickets "seeded" across the ticket print run should allow the game to operate for an acceptable length of time. The game rules require the game to terminate when all five grand prize tickets are claimed. Using the Grand Prize seeding methods, the probability of all five grand prize tickets being won early, while low, is still possible and will result in the game being terminated "early" before ticket sales have generated sufficient revenue, leading to poor monetary performance.

As such, there is a need for a system and method to extend the playtime of an instant win scratch off ticket game.

SUMMARY OF THE INVENTION

According to various embodiments, a system, method, and non-transitory computer-readable medium for increasing the operational lifetime of a lottery game is disclosed. The system, method, and non-transitory computer-readable medium include a game specification having rules for a primary game and a conditional secondary game. The rules include that initial winnings above a predetermined threshold in the primary game allow for entry in the secondary game for a chance to increase the initial winnings.

Various other features and advantages will be made apparent from the following detailed description and the drawings.

BRIEF DESCRIPTION OF THE DRAWINGS

In order for the advantages of the invention to be readily understood, a more particular description of the invention briefly described above will be rendered by reference to specific embodiments that are illustrated in the appended drawings. Understanding that these drawings depict only exemplary embodiments of the invention and are not, therefore, to be considered to be limiting its scope, the invention will be described and explained with additional specificity and detail through the use of the accompanying drawings, in which:

FIG. 4 depicts a sample of scratch off ticket game parameter values according to an embodiment of the present invention;

FIG. 13(*a*) depicts sample rules for an instant win scratch off ticket game with a conditional secondary game according to an embodiment of the present invention;

FIG. 13(*b*) further depicts sample rules for an instant win scratch off ticket game with a conditional secondary game according to an embodiment of the present invention;

FIG. 13(*c*) further depicts sample rules for an instant win scratch off ticket game with a conditional secondary game according to an embodiment of the present invention;

FIG. 13(*d*) further depicts sample rules for an instant win scratch off ticket game with a conditional secondary game according to an embodiment of the present invention;

DETAILED DESCRIPTION OF THE INVENTION

Generally disclosed herein is a system and method to increase the operational lifetime of a scratch off ticket instant win lottery game by incorporating a conditional secondary game function. The secondary game function permits lower tier monetary prizes to be converted to upper tier prizes (Grand Prize) using an "A Priori" probabilistic method. Effectively, this adds more grand prizes to the game which can increase the temporal "lifetime" of the instant win game. Increasing the game lifetime will effectively increase the number of tickets sold prior to the game's termination (all grand prizes have been claimed thus concluding the game) and therefore improves the gross income of the game. If eligible for a prize upgrade, the game participant can play a secondary game at an officially sponsored lottery kiosk. In the event there is a "No Win" outcome on the secondary game play, the game participant keeps the original monetary prize awarded by the scratch off ticket and the player enters an extended playoff round supported by a leaderboard tracking system (if available).

Figure 1:
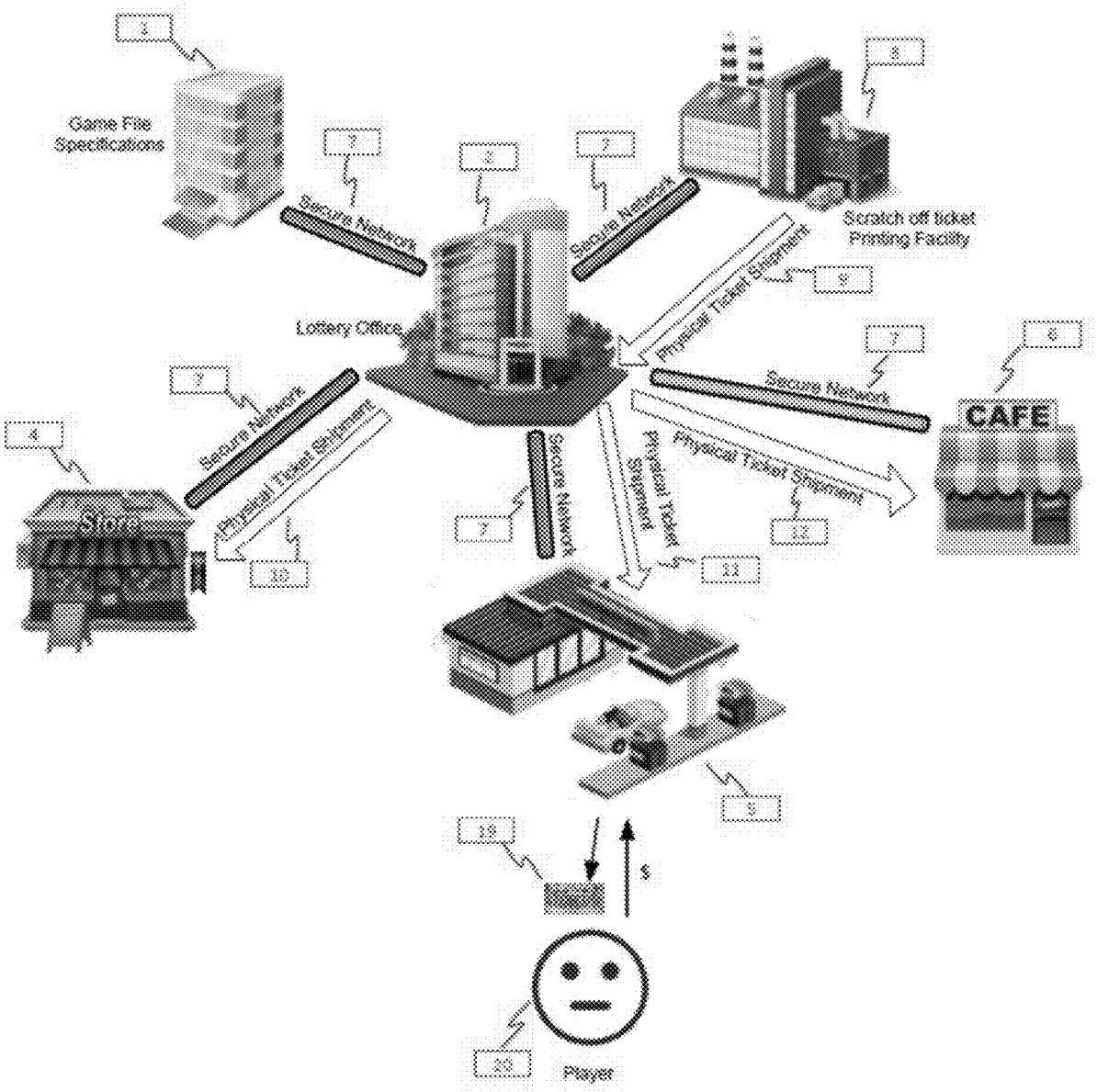
FIG. 1 depicts an example instant win scratch off ticket game system according to an embodiment of the present invention.

FIG. 1 depicts an example of an instant win scratch off ticket game system without a conditional secondary game. A game specification 1 and a set of game rules (not shown) define the characteristics of the scratch off ticket game. The lottery office 2 coordinates the printing and distribution of the lottery tickets to the authorized retailers 4, 5, 6. A game player 20 can purchase a lottery scratch off ticket 19 from one or more lottery retailers 4, 5, 6. The scratch off ticket 19 purchased by the player 20 is printed by the printing facility 3, and distributed to the authorized lottery retailers 4, 5, 6 via the main lottery office 2.

Depending on hidden indicia found on the scratch off ticket 19, the following options are available to the player 20 and the game ends for the player 20:

1) There is no winner amount. There is no further action required by the player 20.

2) The player 20 has won a monetary prize below a specific threshold (the state lottery commission sets this threshold) and is able to "cash in" the scratch off ticket 19 at a lottery retailer 4, 5, 6.

3) The player 20 has won a monetary prize above the specific threshold. The player 20 can mail in a claim form with their winning ticket 19 to the lottery office 2 to receive the monetary prize or directly visit the lottery office 2 and "cash in" a winning scratch off ticket 19.

Figure 2:
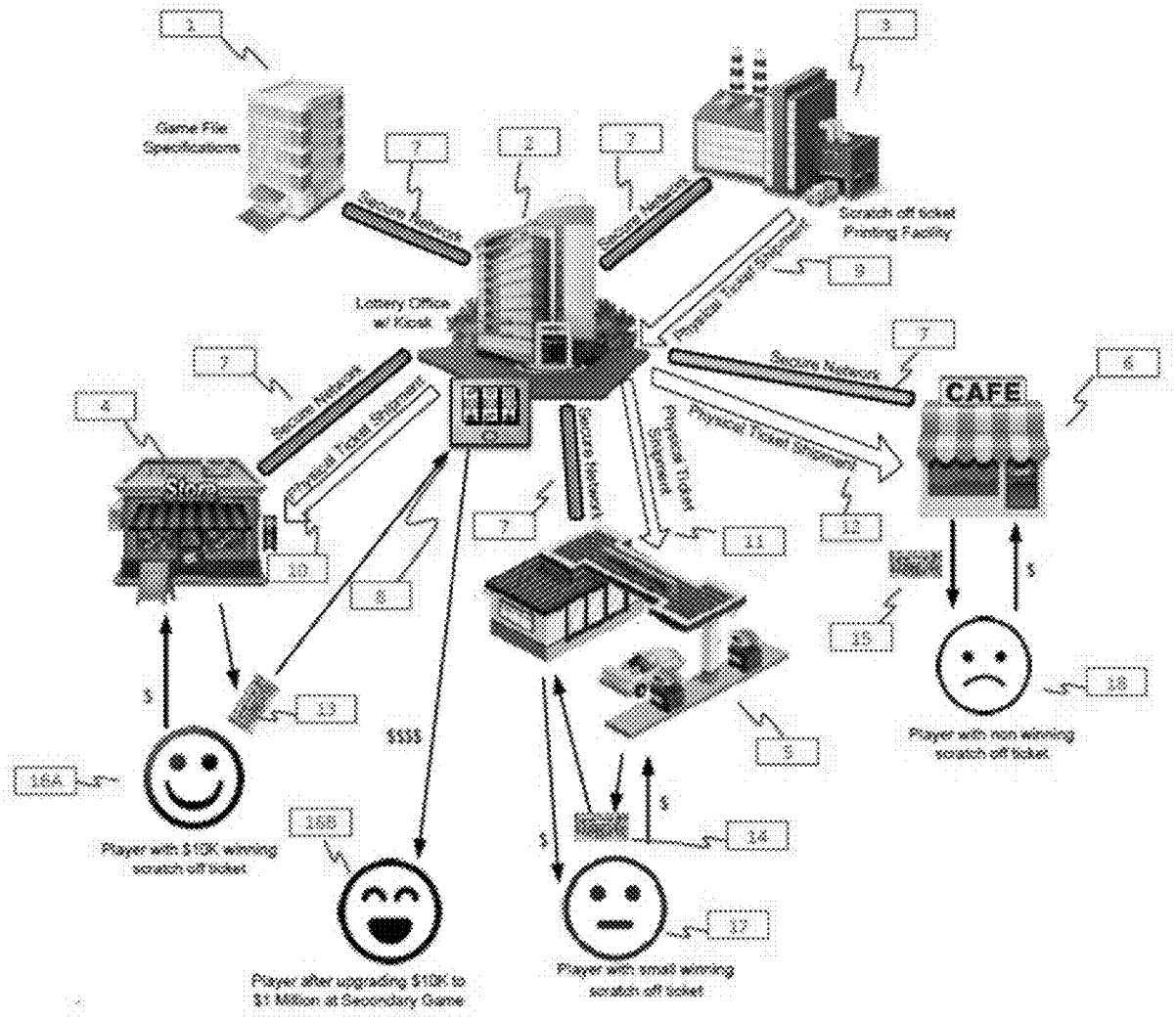
FIG. 2 depicts an instant win scratch off ticket game with conditional secondary game diagram according to an embodiment of the present invention.

FIG. 2 depicts a block diagram representing a lottery system capable of supporting a scratch off instant win lottery game with a conditional secondary game. The process of creating the scratch off game begins with the creation of the game specifications 1. The specification can be developed at a secure site external to the main lottery office 2. Communication of the game specification may occur using a secure data network 7.

Three game participants 16A-B, 17, 18 are shown interacting with the lottery system supporting the scratch off ticket instant win game with the secondary game feature. Player 18 has just purchased an instant win scratch off ticket 15 with the new secondary game feature from an authorized lottery retailer 6. Player 18 has revealed the indicia hidden on the scratch off ticket 15 by rubbing off the removable coating on the scratch off ticket 15. Player 18 has concluded that he has no winnings. To confirm that conclusion, player 18 can return to the authorized lottery retailer 6 and have them confirm the outcome by using an optical scanner to read the ticket information. The ticket information is communicated from the authorized lottery retailer 6 to the main lottery office 2 via a secure network 7 to confirm via the game database (not shown) in the lottery office 2 that the player 18 ticket is not a winner.

Player 17 has made a purchase of a scratch off ticket 14 from an authorized lottery retailer 5. After revealing the ticket 14 indicia by rubbing off the top coating on the ticket 14, player 17 has determined the scratch off ticket 14 represents a small win of $20. According to example game rules (described later with regards to FIGS. 13(*a*)-(*d*)), a $20 win is not entitled to a secondary game play to increase the winnings of player 17. The $20 win is below the threshold where player 17 would have to submit the ticket 14 to the lottery office 2 for payment (according to the example game rules in FIGS. 13(*a*)-(*d*)). Player 17 may seek payment of the winnings at any authorized lottery retailer such as 4, 5, 6.

Player 16A purchases a scratch off lottery ticket 13 from an authorized lottery retailer 4. After exposing the indicia on the purchased scratch off ticket 13, player 16A identifies that they are a $10,000 winner. According to the example rules of the game, the $10,000 prize is above the threshold allowing player 16A to take advantage of the secondary game monetary upgrade. To determine if the ticket 13 will be upgraded to a million-dollar win, player 16A must visit the lottery office 2 and play the electronic kiosk 8 providing a secondary game win opportunity. Player 16A inputs his or her personal details and optically scans the scratch off ticket at the kiosk 8. Once the player's 16A information, which includes information from the scratch off ticket 13, is loaded into and confirmed by the game database (not shown), player 16A may try their luck at the kiosk 8. The kiosk 8 indicates player 16A has just upgraded their winnings to $1,000,000 and leaves with their winnings becoming a million-dollar winner 16B.

The game file specifications 1 are shown as a building separate from the main lottery office 2. However, the building only represents a "placeholder" for development, where a secure computer system (physically and electronically secure) establish the specifications 1. This secure computer system is independent of the main lottery computer system associated with the lottery office 2. The main lottery computer system may reside at a "server farm", which constitutes a large number of computers (example 100 or more) that includes extensive internet secure communications. The main lottery computer system is designed to communicate with the at least thousands of lottery retail outlets (shown as examples 4, 5, 6). The main lottery computer system may also contain one or more computers which support large disk arrays and provides database functionality.

The secondary game kiosk 8 is shown in FIG. 2 to be located at the lottery office 2, but the kiosk (or multiple kiosks) could be at the retail outlets 4,5,6 or a separate location as well. However, regardless of where the kiosk 8 (or multiple kiosks) are, they will communicate to the main lottery computer system and update a database system of the main lottery computer system with secondary game results.

A printing computer located at a printing facility 3, which is separate from the specification computer system for the game specifications 1, identifies the unique contents for every single ticket being printed. For example, if there were 5,400,000 tickets being printed, there would be 5,400,000 records in the file. The ticket printing facility 3 should be both electronically and physically secure.

Figure 3:
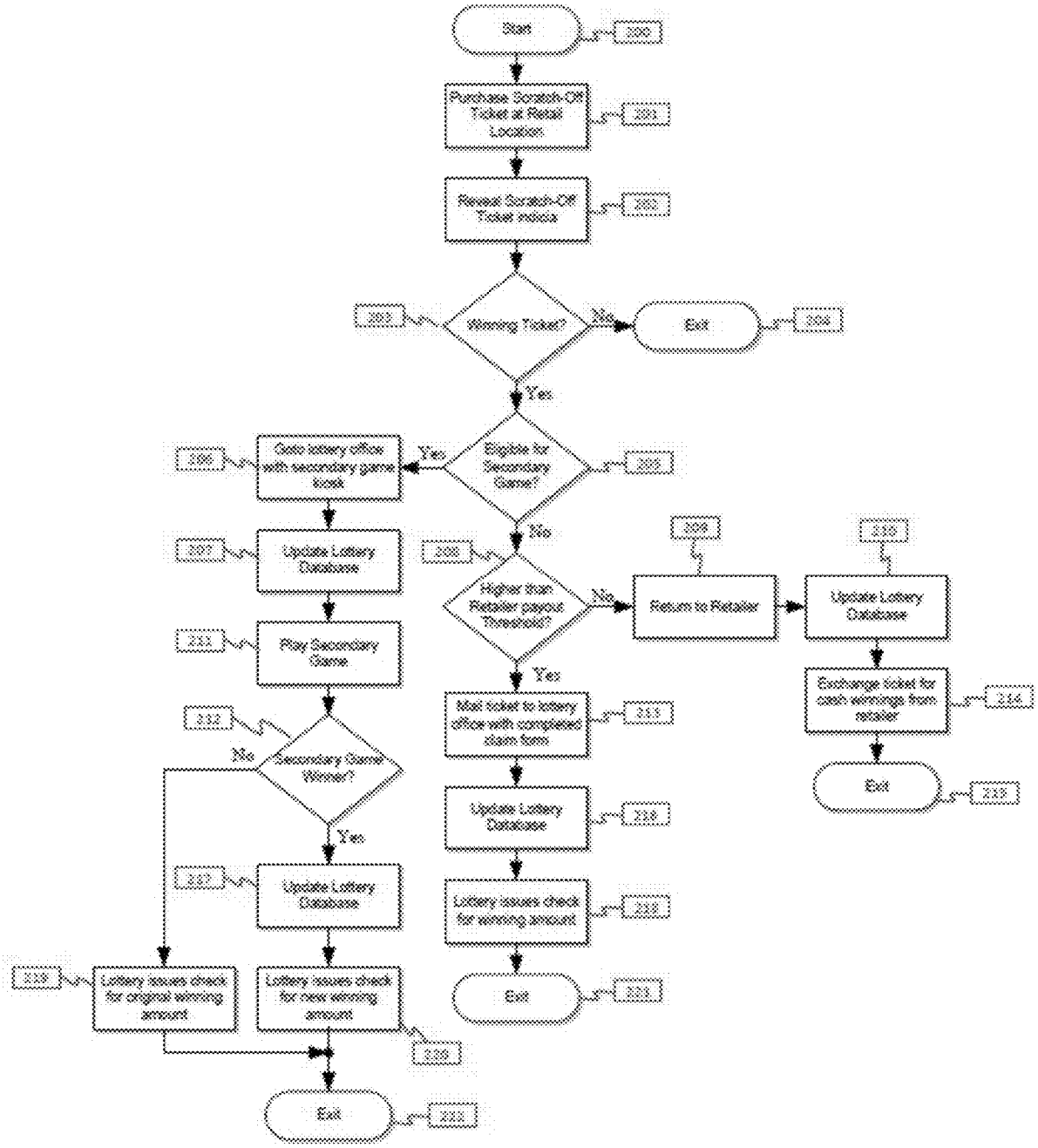
FIG. 3 depicts a scratch off ticket instant win game with conditional secondary game process flow diagram according to an embodiment of the present invention.

FIG. 3 is a process flow diagram demonstrating the typical process a player will perform to play and potentially win a prize, such as a grand prize or a grand prize using the secondary game feature of the game.

Step 200 starts the process. At step 201 the player purchases a scratch off ticket at a retail lottery store of their choice. In step 202 the player scratches off the ticket coating to reveal the underlying indicia. At step 203 the player examines the ticket to determine if there is any win combination. If there is no win combination, the play event is complete and therefore exit 204 occurs. Purchasing another ticket is the only option to "stay in the game".

If at step 203 the player determines they have a winner, the player needs to determine (according to the rules of the game which may state by example a specially marked ticket with a unique symbol or that a certain prize tier must be shown) if the win entitles them to a secondary game upgrade attempt, which occurs at step 205.

If the ticket is not eligible for a secondary game upgrade, at step 208, the player now has to determine if the ticket face value allows for payment at any lottery retailer or if the win amount is above a specific threshold set by the lottery commission (stated in the rules of the game). If the win amount is over the preset threshold, the player will have to mail in the scratch off ticket 213 or visit the main lottery office in order to redeem their winnings. The lottery database is updated at step 216, the lottery will issue a check for the winning amount at step 218, and the event is complete at step 221. If ticket prize value is below the threshold of local reimbursement, the player proceeds to an authorized lottery retailer to collect their winnings 209. The lottery retailer will inform the lottery office of the player's win status, where in turn the game database at the lottery office is updated with the player's win information 210. The player can then receive their winnings from the retailer in exchange for the winning ticket 214 and leave the retailer with their winnings, completing this event 215.

In the event the player's ticket winnings are eligible for enhancement by playing the secondary game feature, the player will have to travel 206 to the nearest secondary game kiosk, which for this example exists at the lottery office. Once at the lottery office, the player will provide their personal information to update the game database 207. The player will then proceed to play the secondary game 211 on the game kiosk. The win determination function (to be described in further detail with respect to FIG. 17) will decide, based on chance, if the player's winnings can be upgraded to the grand prize 212. In the event that the secondary game outcome is a win, the lottery game database is updated 217 and the player receives a check for the grand prize ($1,000,000 by example) 220. If the secondary game outcome was a "no win", the lottery will issue the winnings originally won on the scratch off ticket 219. This event then ends at step 222.

For the sample game that players, such as players 16A-B, 17, and 18, are participating in, FIG. 4 provides the sample game parameter values. The parameter values may vary from game to game and will be established as part of the game file specifications 1. In this example, there will be a total of 5,400,000 scratch off tickets printed for the game. The prize schedule in FIG. 4 shows the individual prize counts for each monetary prize tier. From the print run size and the tier level prize counts, the odds of purchasing a ticket at a specific tier level can be calculated. By example, there are just five $1,000,000 tickets available. This defines the odds of purchasing a ticket worth $1,000,000 at 5/5,400,000 or 1 in 1,080,000. As shown, there will only be 5 printed tickets with a face value of $1,000,000 (Grand Prize) for the sample game. This is also the case for the $100,000 ticket count.

Figure 5:
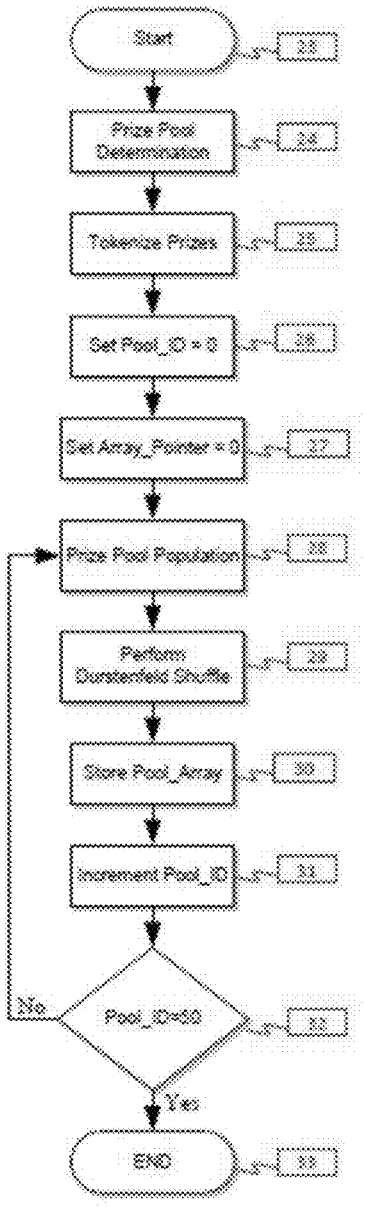
FIG. 5 depicts a flow diagram of populate and shuffle prize pool arrays according to an embodiment of the present invention.

FIG. 5 is a prototypical method flow chart for the population and randomization of the fifty prize pool arrays, to be performed by the secure computer system that establishes the game specifications 1. The function begins at "start" 23. The first step in the process is to call the subroutine prize_pool determination 24 function. A table is loaded into memory which assigns a token number to each prize level 25. Variables called Pool_ID and Array_Pointer are initialized to zero 26, 27. The Pool_ID variable identifies which prize pool is currently being processed and the Array_Pointer variable identifies which element is currently being processed. The subfunction Prize Pool Population 28 is called next. Once the prize pool array is populated with the appropriate prize tokens, another subfunction is called to Perform a Durstenfeld Shuffle 29 to randomize the prize pool array. When the randomization is completed the Prize Pool_Array is stored 30 into the Lottery Office main database (not shown). The variable Pool_ID is incremented by one 31. The variable is then checked to see if it is equal to fifty 32 indicating if there are more prize pool arrays to populate and shuffle. If there are more arrays to populate the method begins to populate the next array 28; otherwise, the method ends 33.

Figure 6:
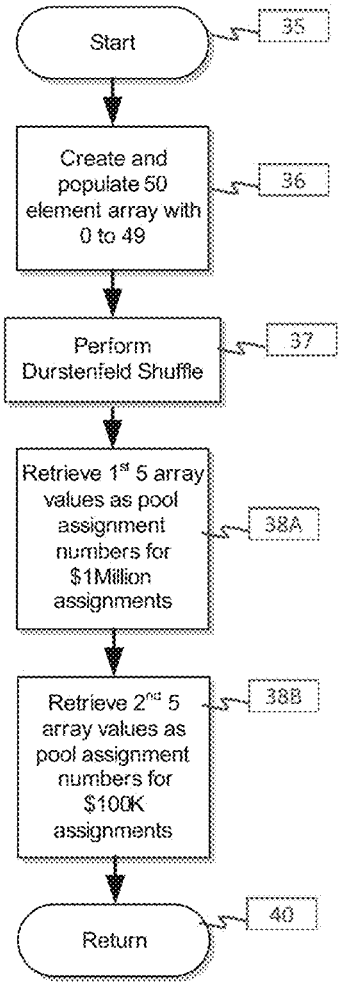
FIG. 6 depicts a flow diagram of prize pool determination according to an embodiment of the present invention.

FIG. 6 is the method flow chart used to determine which prize pools will contain the prizes which are less than one per pool as defined in the game specifications 1. This method is performed by the secure computer system that establishes the game specifications 1. In this example, the Prize Determination method will determine which prize pool array will contain the token numbers for the $1,000,000 (token #10) and $100,000 (token #9) prizes. The function enters at Start 35 and creates a temporary array of 50 elements and populates the positions with values between 0 to 49 representing the 50 prize pool arrays 36. The method next performs a Durstenfeld shuffle 37 to randomize the values of the array. When the shuffle is completed the first 5 array elements are retrieved 38A and will be used to indicate which prize pool will contain the token number for the prize of $1,000,000. The next five elements are retrieved and will be used for the assignment of the $100,000 token numbers 38B. The method returns 40 the values to the calling routine.

Figure 7:
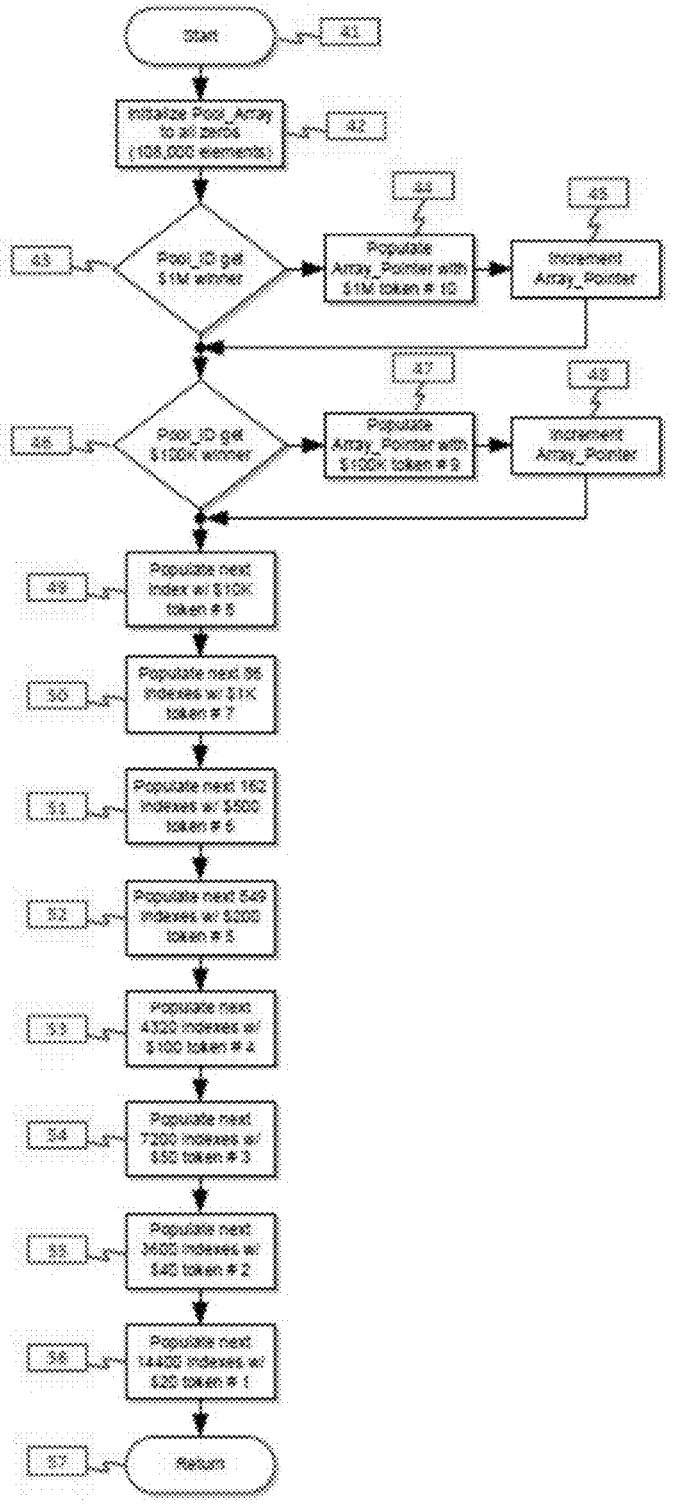
FIG. 7 depicts a flow diagram of populating a prize pool with associated prize tokens according to an embodiment of the present invention.

FIG. 7 is the flow chart for the method which populates each of the 50 prize pool arrays with the tokens for the prizes available to win. The process is performed by the secure computer system that establishes the game specifications 1. The method begins by creating a pool_array with 108,000 elements all assigned to zero 42 which is the token number for a non-winning scratch off ticket. The method then checks if the Pool_ID variable (which is passed from the calling array) indicates this is a pool array which receives the token for a $1,000,000 ticket 43. If so, the method replaces the element in the pool array at location of the array_pointer with token #10 44 before incrementing the array_pointer 45. The method next checks to see if this pool_array will contain the token for a $100,000 winner 46. If yes, the method updates the current element to #9 47 before incrementing the array_pointer 48. As there is one $10,000 winner per prize pool the method populates the next index with token #8 49. Not shown is the process of incrementing the array_pointer by the number of indexes updated, in this case the pointer is incremented by one. The next 86 indexes are populated with token #7 for the $1,000 winners 50 and the array_pointer is incremented by 86 also (not shown). The method populates the next 162 indexes with token #6 51, increments the array_pointer (not shown) before populating the following 549 indexes with token #5 52. The method continues the population of the specified number of indexes 53, 54, 55, 56 of the array and incrementing of the array pointer (not shown) for each prize level. The remaining indexes in the pool_array have already been initialized to zero, which is the token number for non-winning scratch off tickets. The method returns to the calling method 57.

Figure 8:
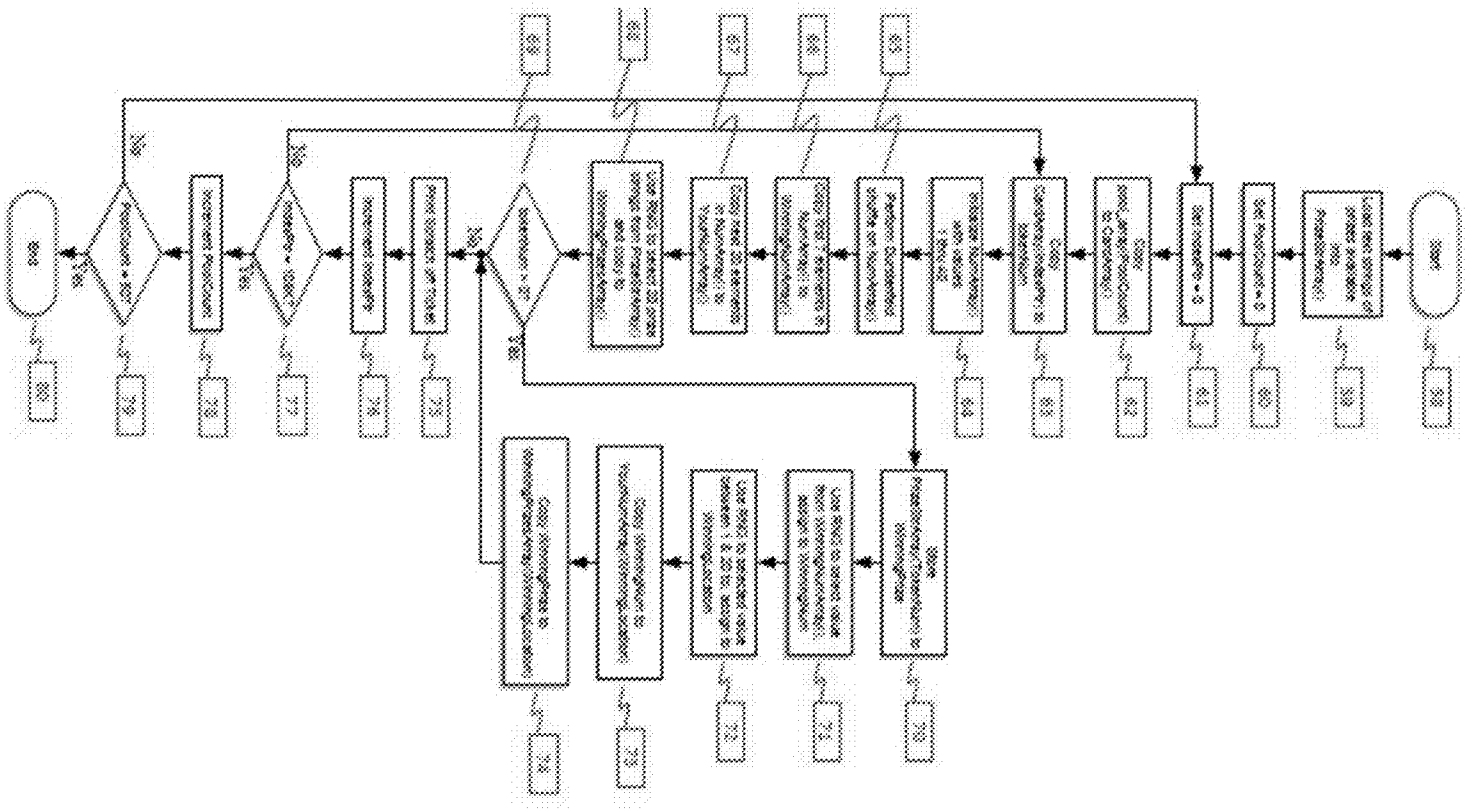
FIG. 8 depicts a flow diagram of scratch off ticket formulation and printing according to an embodiment of the present invention.

FIG. 8 is a process flow chart for the creation and printing of the scratch off lottery tickets. The computer system at the printing facility will contain a program from the lottery office which would receive over a secure network all data required to create the scratch off tickets. This process flow would be a part of that program. The process would begin 58 by reading a text file which contains the text strings of the prizes available and storing them in a PrizeStrArray 59. The variables PoolCount and IndexPtr would be initialized to zero 60, 61. The PoolCount variable identifies which prize pool is currently being processed and the IndexPtr variable identifies which element is currently being processed. The first pool_array with an index of zero (pool_array(PoolCount)) is copied to a temporary array called CardArray( ) 62. This array contains the 108,000 elements of Token ID numbers. The token number located at CardArray(IndexPtr) is copied to a temporary variable named tokenNum 63. This will be used later in the element to determine if the scratch off ticket to be printed will be a winning or non-winning ticket. Based on the rules (FIGS. 13(*a*)-(*d*)) the range of numbers used for this game is 1 to 40, therefore an array called NumArray is created and populated with the number 1 to 40 at step 64. A Durstenfeld shuffle is then performed on the NumArray( ) 65. After the randomization is complete, the first 7 elements are copied to a new array called WinningNumArray 66. The next 20 elements will be copied to an array called YourNumArray( ) 67. These two sets of numbers will be printed in the scratch to reveal sections on the physical scratch off ticket in the "winning numbers" 153 area and the "your numbers" 154 area (to be described later with respect to FIG. 15). In step 68, the program communicates with a random number generator (RNG) to randomly select the prize that will be printed on the ticket.

Prior to printing however, the tokenNum variable is checked 69. If tokenNum equals zero, the ticket is a non-winning ticket and the process can go directly to the printing process. If the value is greater than zero the ticket should be a winner so the method must modify the YourNumArray( ) so one element matches an element in the WinningNumArray.

The method will first copy the text string for the winning prize from PrizeStrArray(tokenNum) to a temporary variable WinningPrize 70. The method will interface with a true random number generator (RNG) to select which index in the WinningNumArray( ) will be used as the matching numbers and will copy to a temporary variable called WinningNum 71. The method will next interface again to the RNG to determine which location in the YourNumArray will contain the matching number and will assign that to the WinningLocation variable 72. The method then replaces the number at the index YourNumArray(WinningLocation) with the number stored in the WinningNum variable 73. The program will also replace the text stored at WinningPrizesArray(WinningLocation) with the WinningPrize variable 74.

The various arrays associated with the Winning Numbers and Your Numbers area are now properly populated and the scratch off ticket can now be printed through a specialized printing process which will be known by those skilled in the art 75. Once the specialized printing process is completed, the indexPtr variable is incremented by one 75 and checked to see if it is equal to 108,000 at step 77. If IndexPtr is less than 108K, the module copies return to the step of reading the next TokenNum 63. If IndexPtr equals 108K, then all tickets in that prize pool have been printed and the variable PoolCount is incremented by one 78. The method then compares the PoolCount to 50 at step 79 to check if there are more prize pools left. If there are, control of the module returns to setting the IndexPtr to zero 61. If all 5,400,000 scratch off tickets have been printed, the method ends 80.

Figure 9:
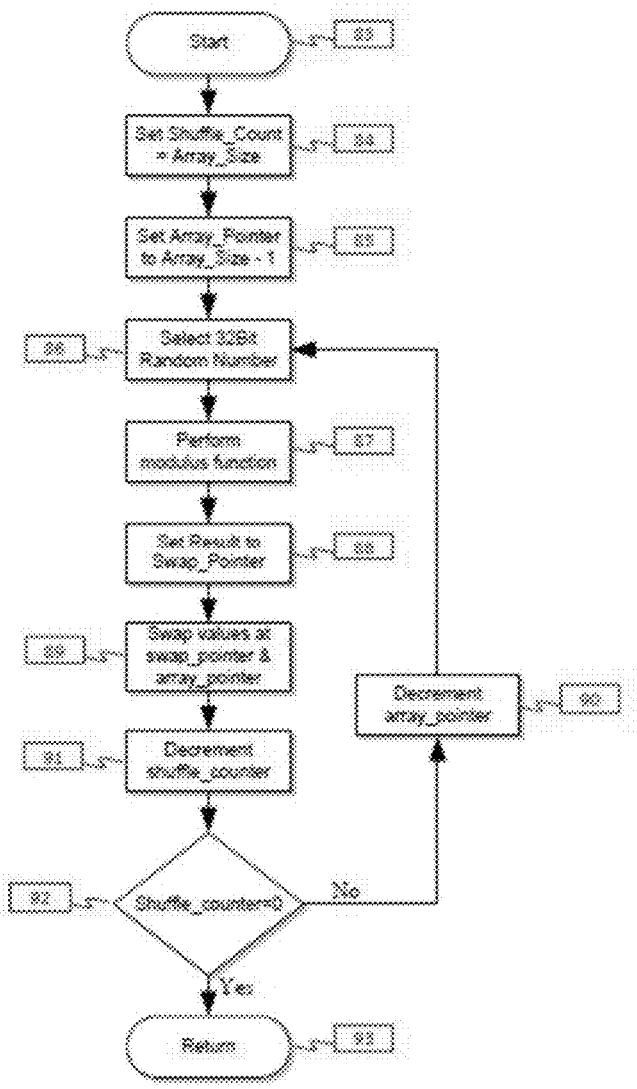
FIG. 9 depicts a flow diagram of a Durstenfeld shuffle function according to an embodiment of the present invention.

FIG. 9 shows a process flow chart for the Durstenfeld Shuffle function used to randomize the various data arrays. The process enters the function through the Start 83 block. Since various routines utilize this function, the Shuffle_Count variable must be set to equal the Array_Size 84 and the Array_Pointer variable is set to Array_Size−1 at step 85. Once a 32-Bit True Random Number is generated 86 a non-truncated biased modulus function is performed 87 to ensure the Random Number generated is within the range of 0 to Array_Pointer. The result of the modulus function is set to the Swap_Pointer 88 and the values in the array stored at Array_Pointer and Swap_Pointer are transposed 89. The variable shuffle_count is decremented by one 91 and checked to see if it is equal to zero 92. If shuffle_count is not equal to zero, there are more elements to shuffle so array_pointer is decremented by one 90 and the process repeats from the selection of the 32-bit number 86. Once shuffle_count equals zero, the shuffle of the array has been completed and the function can return 93 to the calling routine.

Figure 10:
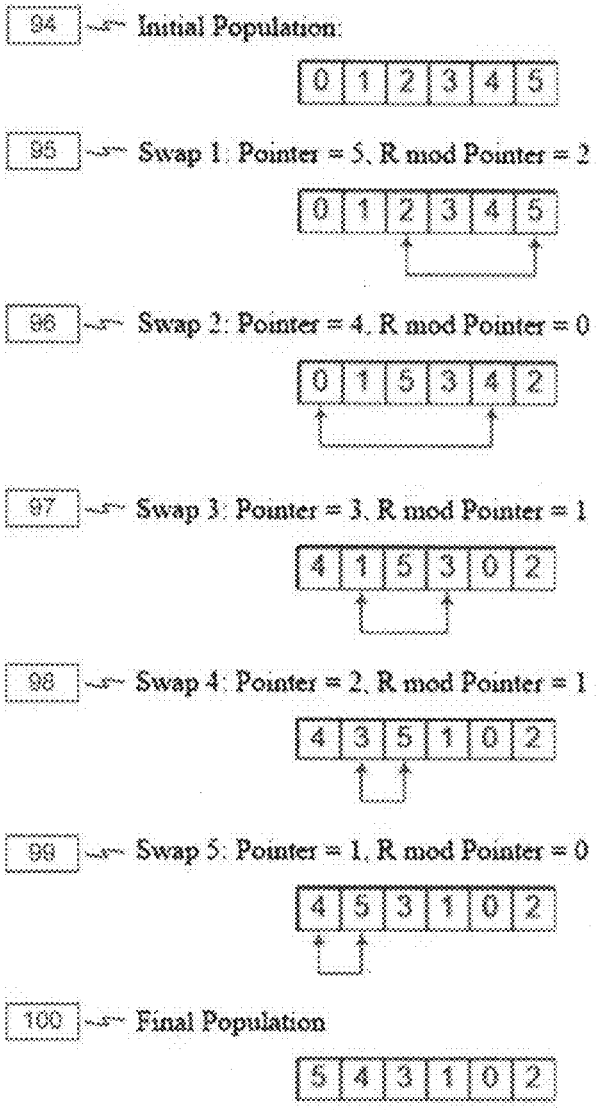
FIG. 10 depicts an example of a Durstenfeld shuffle according to an embodiment of the present invention.

FIG. 10 shows an example of the Durstenfeld shuffle function on a six-element array. The initialization and population 94 of the array would be performed prior to this function being called and would be 0,1, 2, 3, 4, 5. In Swap 1 at step 95, the variable "array_pointer" has been set to array_size−1 (refer to FIG. 9 block 85). A true random number has been generated (FIG. 9 block 86) and a modulus function has been performed (FIG. 9 block 87) resulting in R mod Pointer equal to two. The values in the array at position 5 ("array_pointer") and position 2 ("swap_pointer") are transposed (FIG. 9 block 89). Not shown is the shuffle_count variable being decremented by 1, determining shuffle_count is not zero, and decrementing the array_ pointer (FIG. 9 blocks 91, 92, 90).

In Swap 2 at step 96 the result of the R (random number) mod Pointer ("array_pointer") is zero. Therefore, the values in the array at locations zero and four are transposed. Swap 3 at step 97 has R mod Pointer equal to one so the value "1" stored at array location one is transposed with "3" which is stored at array location three. Swap 4 at step 98 again has R mod Array_Pointer (now equal to two) equal to one. The two values at the array locations one and two have already been swapped by previous loops but are once again transposed to new locations. The routine continues through one more loop as Swap 5 at step 99. Once the values are transposed in swap 5, the function will decrement the shuffle_count and determine there are no more swaps to occur and will return to the calling function with the final contents 100 of the array being 5,4, 3, 1, 0, 2.

Figure 11:
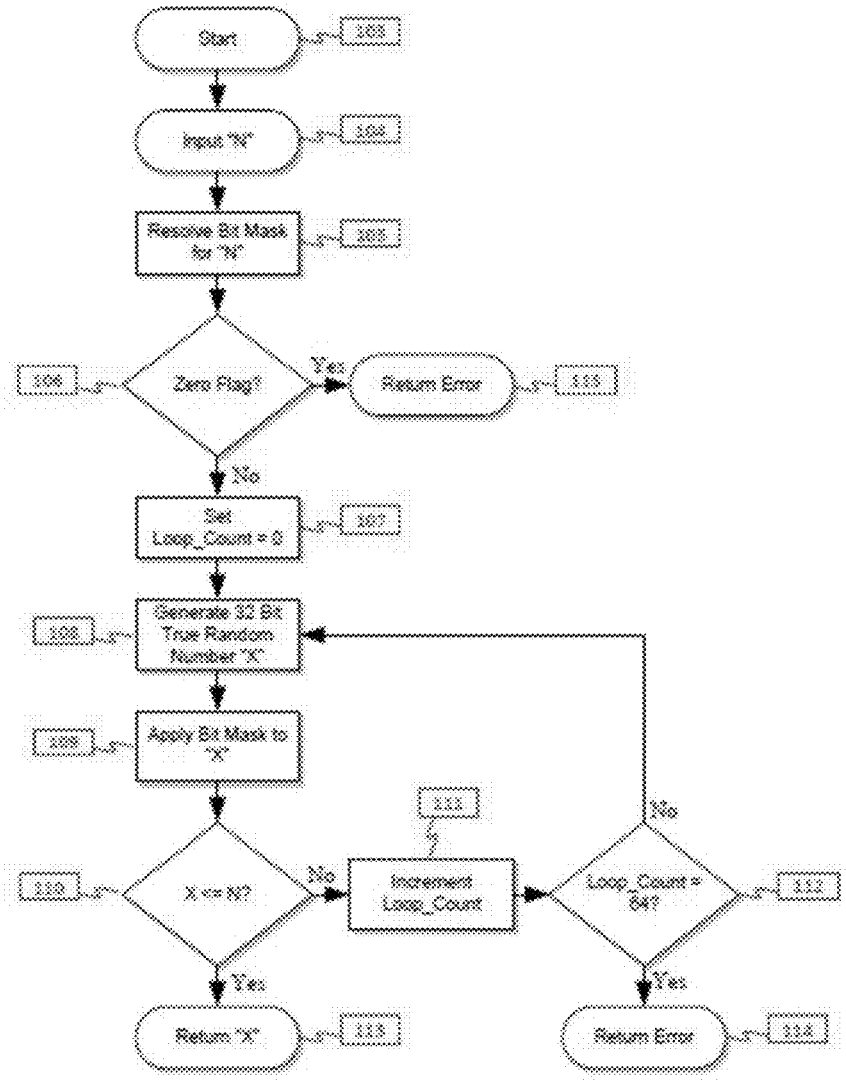
FIG. 11 depicts a flow diagram of a true random number generator with modulus according to an embodiment of the present invention.

FIG. 11 is a flow chart for the process of generating a true random number between the vales of 0 and "N". The process is performed by an RNG embedded computer connected to the computer system establishing the game specifications 1. The term true indicates that some physical source of noise or random behavior is being measured and an unsigned 32-bit digital number is produced. Some examples of physical random sources are nuclear decay of a radioactive material, white noise voltages produced by a resistor at a specific temperature, randomly phased oscillators being sampled, or semiconductor "shot" noise, to name a few examples. The key attribute of the various "noise" sources is that they are non-deterministic in terms of behavior and can only be described on a statistical basis. Usually the physical noise source is "whitened" using software to decorrelate sample values.

If left at an unsigned 32-bit integer, the random values would vary from 0 to 4,294,967,296.

When targeting specific probabilities, a modulus function is used to set the upper limit on the random outcome, by example 1 in 100. A modulus of 100 applied to the 32-bit raw random number value will produce a random value of 0-99. The modulus function is based on an arithmetic decision function generally expressed as: N/D, remainder R. By example, if N is 10 and D is 8, then R=2. For the purpose of random number generation, the modulus function introduces "truncation bias" which will affect the statistical outcome. The effect of truncation bias must be compensated for when producing random integer value between 0 and "N".

Step 103, 104 starts the function of generating a 32-bit unsigned random number between a value of 0 to "N", where N is an input variable defining the upper limit of the random number return. Step 105 determines an "ANDing" logical mask to be applied to the modulus "N" to correct for truncation bias (FIG. 12 will describe this in further detail below). Step 106 traps an error whereby the modulus is 0 and returns to the calling function at step 115. Step 107 starts the process of requesting an unsigned 32-bit hardware generated random number. Step 108 executes a suitable function to access the true random number generator. Step 109 applies the truncation correction bit mask.

Step 110 determines if the random number exceeds the modulus limit defined by the bit mask. If the random number is within the limits of the bit mask, the value is returned at step 113. If the random number exceeds the bit mask limit, the loop count is incremented at step 111 and the loop_count limit is checked (64 in the example). If loop_count is 64 at step 112, then an error is declared at step 114, otherwise a new random number is selected, returning to step 108.

Figure 12:
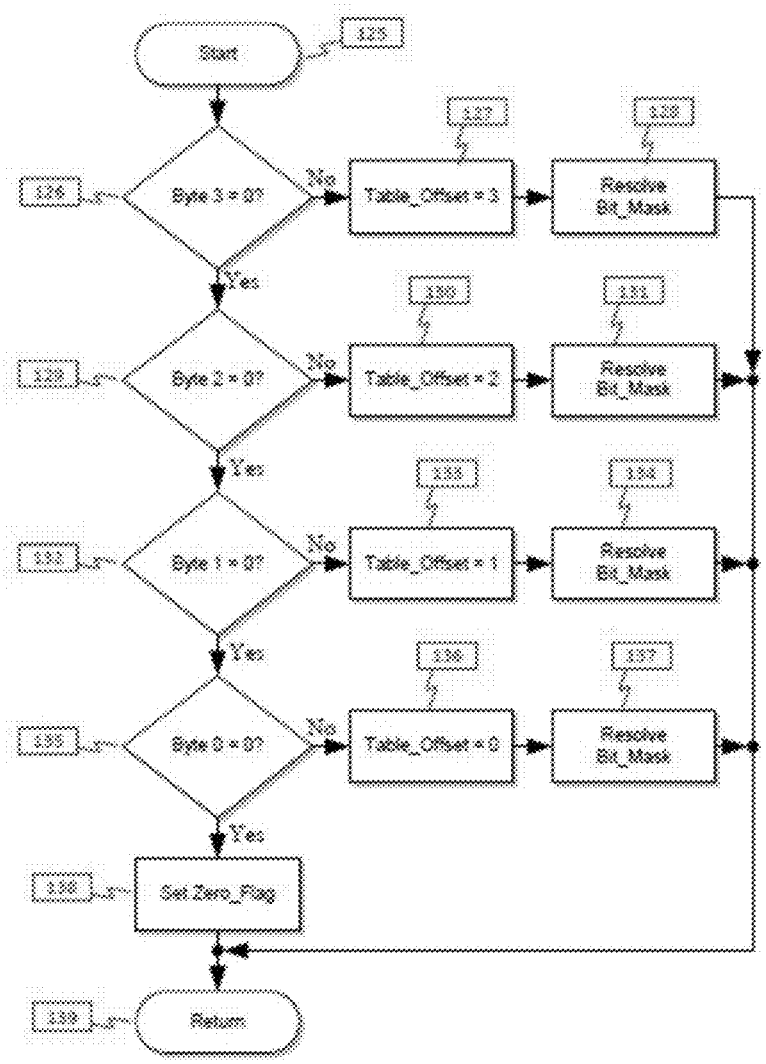
FIG. 12 depicts a flow diagram of a resolve modulus bit mask function according to an embodiment of the present invention.

FIG. 12 provides details on creating a modulus bit mask in flowchart form. The modulus value is in a 32-bit unsigned format, which can be broken into four 8-bit groups (bytes). Each byte of the modulus is checked for a non-zero value 126, 129, 132, 135. If found, a bit mask will be resolved 128, 131, 134, 137 and the function exits 139. If all four groups are set to 0, then the modulus is set to 0, which is an illegal value. If a 0 modulus is detected, an error flag is set (zero_flag) at step 138 and the function exits 139. The index into a table containing the applicable mask is assigned to Table_Offset variable 127, 130, 133, 136.

FIGS. 13(*a*)-(*d*) represent an example of the rules associated with a conditional secondary game instant win scratch off game. The rules indicated the name of the associated game and a game ID number along with the cost to purchase a scratch off ticket from an authorized lottery retailer. The play symbols which may appear in the "Winning Numbers" and "Your Numbers" area are defined as well as the prize symbols to be used in those areas. Also defined are the available prizes that can be won on a scratch off ticket and the total number of tickets that will be printed for this game.

How and which prize a player wins is defined next in the rules. There is a table included in the rules that shows in more detail the prizes available to win, the odds of winning each prize and the number of tickets printed that will contain each of the prizes.

There should be a section in the rules which describe various aspects of the conditional secondary game drawing such as the eligibility to enter the secondary game and how the player would participate in the game. Also indicated is the maximum number of conditional secondary game winners (10). There is also a table which shows which prizes can be won in the conditional secondary game dependent on the original amount won on the scratch off ticket. In this example the player has a chance to win $1,000,000 if their original scratch off ticket was a winner for the amounts of $1000, $10000 or $100000. The table also indicates that odds of winning the secondary game based on the original win amount.

Some lotteries may offer retailer incentive awards and bonuses for selling lottery tickets specifically winning lottery tickets. If so, the details of these awards and bonuses will be described in the game rules. There is also a disclaimer indicating the time frame to redeem a winning scratch off ticket, which laws will be in effect for this game (which is typically the state where the lottery office is located), and how the player may redeem their winning scratch off tickets.

There is a disclaimer that the lottery office may announce a termination date which would end the sale of this games scratch off tickets. A termination date may be announced for several reasons such as a predetermined date or all top prize tickets have been redeemed.

Figure 14:
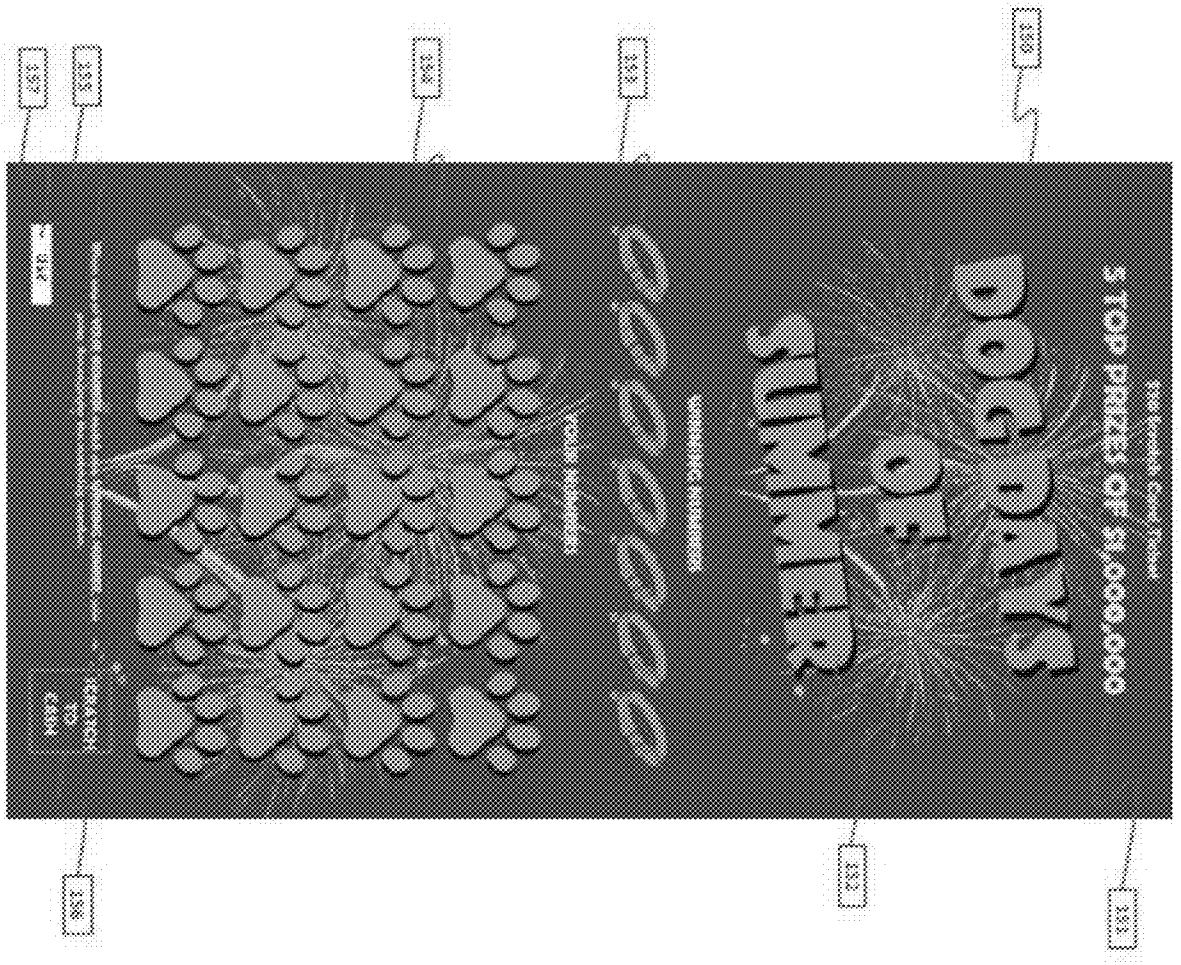
FIG. 14 depicts an example of a scratch off ticket with indicia hidden according to an embodiment of the present invention.

FIG. 14 illustrates the front of a prototypical instant win or scratch-off ticket 150 for a lottery game series named "Dog Days of Summer" 152. The ticket measures approximately 4 inches wide x 8 inches long, though this is not limiting and any dimensions can be used. In this example the "Dog Days of Summer" 152 lottery game series has 5 top prizes of $1,000,000 151.

There are multiple scratch-to-reveal areas on this scratch off ticket 153, 154, 156 which are shown in their initial state (unrevealed). In this example, scratch-to-reveal area "winning numbers" 153 contains the numbers that must be matched in the "your numbers" area 154 for the player to win prizes. Area 155 of the scratch off ticket 150 gives the player a brief description of how to win prizes. If any number revealed in "winning numbers" area 153 are revealed in the "your numbers" area 154, the player will win the amount shown under the matching number.

A control number 157 which typically indicates the ticket position on a roll of tickets is shown in the lower left corner of the ticket. In this example the control number 157 indicates the ticket was the twelfth ticket on the roll. The "scratch to cash" area 156 is another scratch-to-reveal area. When revealed, this area 156 typically displays a type of bar code used to electronically scan the ticket and to verify if the scratch off ticket 100 is a winning or non-winning ticket as stored in the lottery authority's central database.

Figure 15:
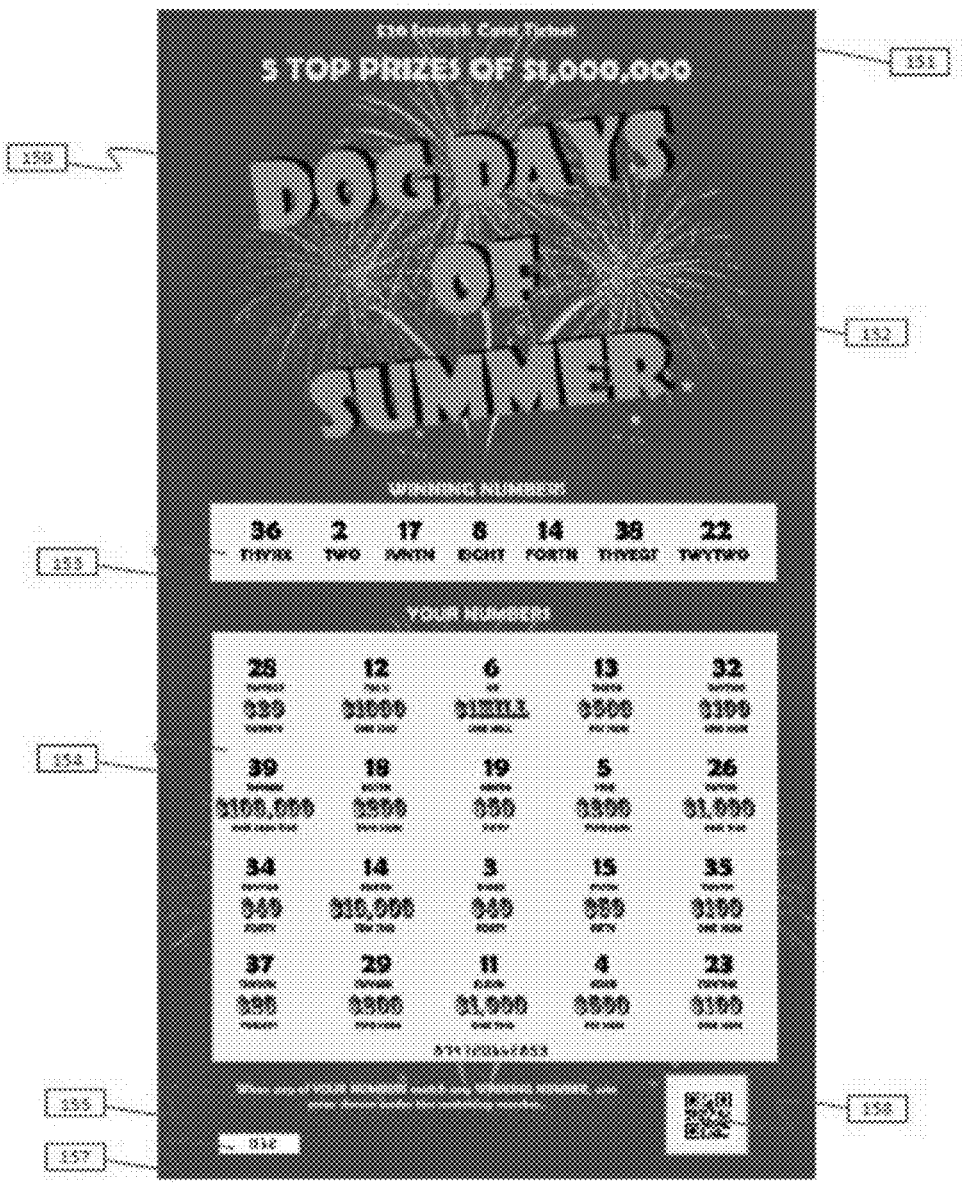
FIG. 15 depicts an example of a scratch off ticket with indicia exposed according to an embodiment of the present invention.

FIG. 15 illustrates the front of the scratch off ticket 150 for the lottery game "Dog Days of Summer" 152. In this figure, the scratch-to-reveal areas 153, 154, 156 are in their final state with the hidden indicia revealed. The winning number area 153 shows the seven numbers that can be matched for the player to win prize(s). In this example the player can win a prize if any of "36, 2, 17, 8, 14, 38, 22" are also shown in the "your numbers" area 154. There are twenty numbers allocated to the player in the "your numbers" area 154. In this example the number "14" appears in both the "winning numbers" area 153 and the "your numbers" area 154 allowing the player to win the prize amount shown below the number "14" in the "your numbers" area 154. In this example the winning amount is $10,000. Referring to FIG. 13(*a*)-(*d*) "Sample Rules", this ticket would allow the player to use the secondary game kiosk to possibly increase their winnings to $1,000,000.

A quick response (QR) code 158 is revealed in the "scratch to cash" area 156 in the lower right corner of the scratch off ticket. This code can be electronically scanned with an optical scanner at an authorized lottery retailer and/or at the secondary game kiosk to confirm the ticket is valid and has not been previously redeemed.

The disclosure of a ticket sales maximization method and system using a secondary game constitutes the improvement over the prior art instant win scratch off ticket games.

There are at least two fundamental variants (embodiments) of the secondary games that may be deployed. Both embodiments are designed to increase the number of grand prize tickets by upgrading lower tier monetary prizes to a grand prize value conditionally, using an a priori method with true random number generators.

The first variant for the secondary game feature uses a Bernoulli Trial to produce a win or no-win outcome.

The second variant of the secondary game produces a score for the player using, by example, dual spinning wheels whereby, the stop positions of the wheels are combined algebraically. By example, two wheels are implemented in a video format using a computer application program to execute the procedures required. Both wheel one and wheel two have 32 slots labeled 0 through 31. The formula used to generate a random number between 0 and 1023 is:

$$X=(32\times N)+M$$

While this example uses a linear equation, it is not intended to be a limitation for the invention. Other formulations can be used such as exponential, quadratic, etc.

The variable "X" represents the final random value. The variable "N" represents the slot position on wheel one (0-31). Variable "M" represents the slot position of wheel two (0-31). A true random number generator with a modulus of 32 is used to generate the values "M" and "N". The software application will render the video image to simulate wheel movement and have the wheels "stop" at a final location based on the random values of "N" and "M".

The "scoring" feature of the second embodiment of the secondary game feature permits further flexibility when providing for multitier winner upgrades. Number ranges such as "0-50" to upgrade a $1,000 win or "51-70" to upgrade a $5,000 win can be implemented with this method. Also, for tertiary competitions, such as no-category (range 500-1023 upgrade by example), can be used as a final playoff and prize upgrade option.

By policy, the secondary win upgrade feature may guarantee one or more players will have their monetary winnings value transformed into a grand prize. However, it is possible that the secondary game methods described herein may not produce an upgraded winner based on the probabilistic nature of the secondary game process. As such, a further system element and method may be added using a leaderboard to keep track of players that failed to receive an upgrade to their scratch off winnings. After all the potentially upgradable tickets have become sold and/or played, a determination is made to identify any upgrade winners. If none are found, then the players placed in the leaderboard may replay the secondary game on a FIFO (first in, first out) basis.

Figure 16:
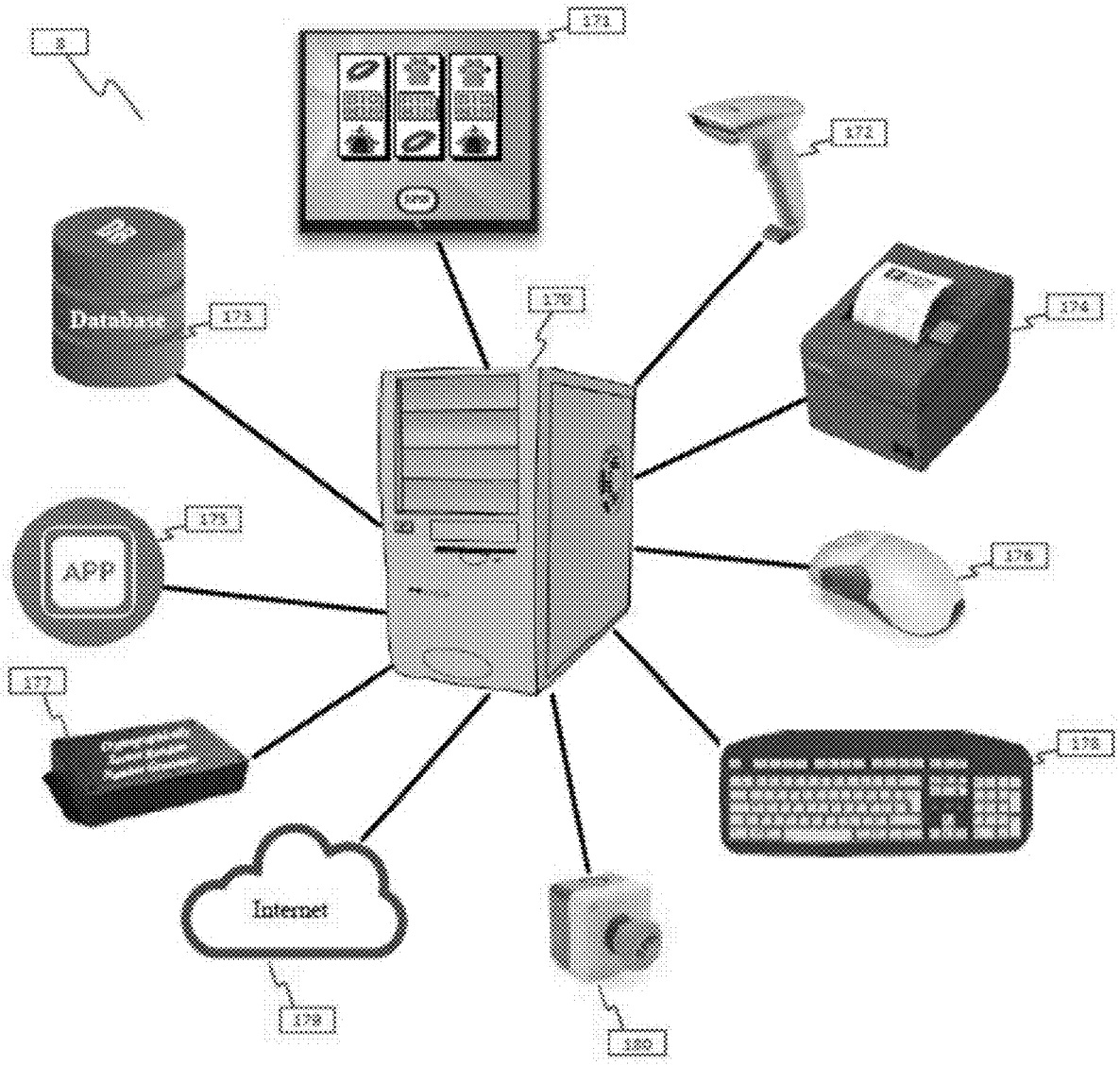
FIG. 16 depicts an instant win scratch off ticket secondary game kiosk according to an embodiment of the present invention.

FIG. 16 is a block diagram of a subsystem identified as the secondary game kiosk 8. The kiosk 8 is a subsystem which communicates with the lottery office 2 computer system and database (not shown). The kiosk may include the following elements:

The computer system 170 contains a central processing unit, hard disk drive, and sufficient random-access memory (RAM). The software operating system may be a Microsoft version of Windows, Linux or Unix, or a suitable software system applicable to the kiosk 8. A custom application program 175 will interact with the various physical elements of the kiosk 8 (as seen below). The kiosk 8 may maintain a local database 173 to record transactions for secondary game play events.

Part of the kiosk 8 is a screen 171, such as an LCD screen, which serves multiple kiosk 8 functions such as player information entry or allowing a player to participate in the secondary game opportunity. In FIG. 16 the secondary game example is that of an electronic slot machine. The slot machine represents an example of a secondary game implemented as a Bernoulli trial outcome. Other games of chance can be incorporated and the use of a slot game of chance is not to be considered limiting.

The optical scanner 172 is used to read critical information found printed on the player's scratch off ticket. The ticket information may be stored in the kiosk 8 local database 173 as well as confirmed and stored in the lottery office 2. The ticket information is verified from the ticket information used in the initial printing process at the ticket printing facility 3.

A printer 174 is used to provide a receipt for the game player indicating that they had played the secondary game. The receipt will include the time and date the secondary game was played, as well as key ticket information and the outcome of the secondary game once played.

The mouse 176 and keyboard 178 are standard input devices for the kiosk 8 that permit player information to be logged into the kiosk 8 prior to the player playing the secondary game. The mouse 176 and the keyboard 178 are also required when an authorized technician is performing maintenance on the kiosk 8. It should be noted that the mouse/keyboard functionality can also be incorporated into the screen 171 as a touchscreen.

The momentary push button 180 is connected to the kiosk 8 using a standard interface such as USB. The player will press the button to activate the play sequence of the secondary game. This can also be implemented in the screen 171 as a touchscreen.

The internet connection 179 is used to communicate with the lottery office computers (not shown).

The secondary game enhancement uses an entropy source (such as random number generator 177) to determine if a player's winning amount will be upgraded to a higher value.

The application program 175 is the custom software to implement the secondary game, as well as manage local database 173 information and communicate with the lottery office 2 using the internet portal 179.

It should be understood that the kiosk 8 in the example system is located in the lottery office 2. However, this is by example only, in that multiple kiosks 8 can be supported. By example, every authorized lottery outlet 4, 5, 6 may have a secondary game kiosk 8 at their physical location, or a secondary game kiosk 8 could be at any other alternative location. In the event that multiple kiosks 8 are deployed throughout the system, each kiosk 8 will have a unique electronic identifier.

Figure 28:
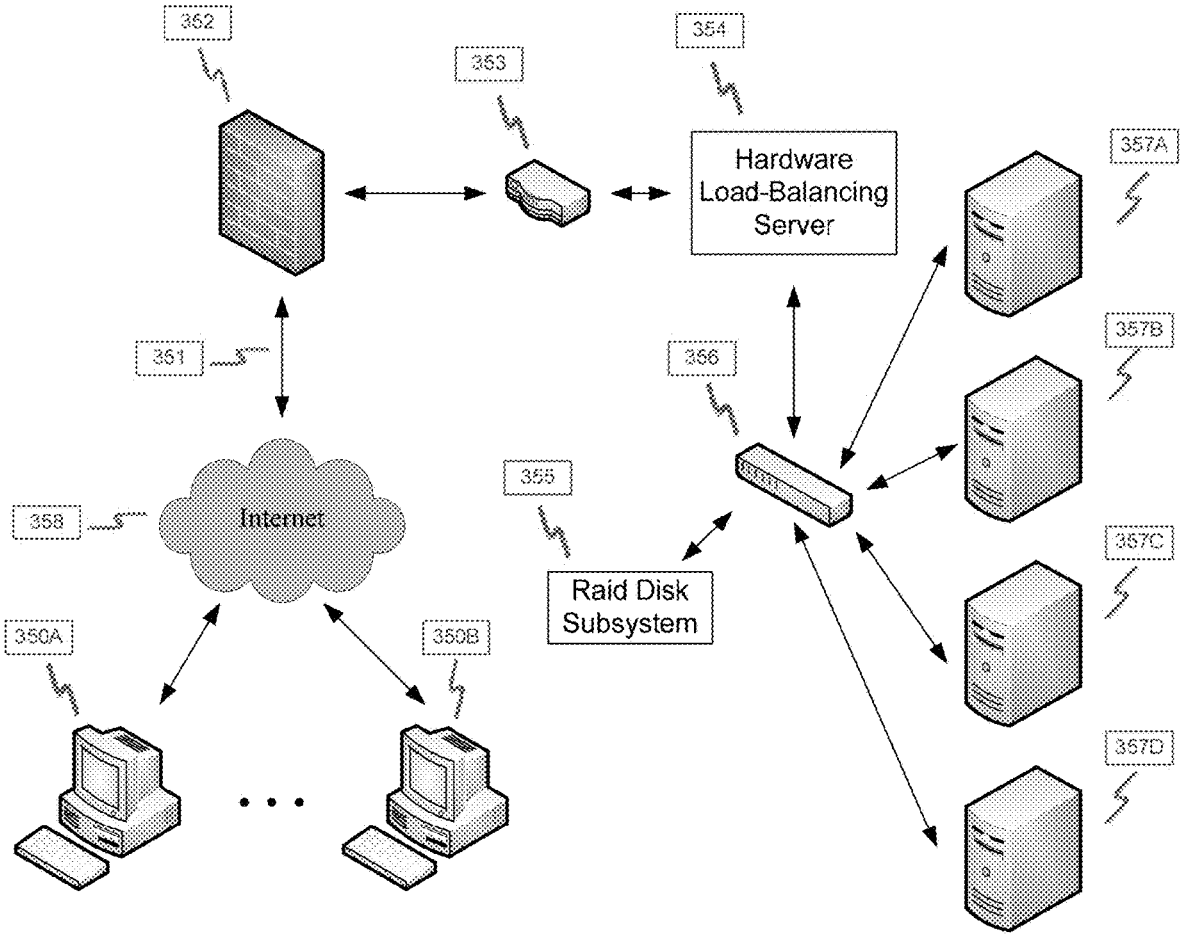
FIG. 28 depicts an example of a server farm according to an embodiment of the present invention.

FIG. 28 depicts an example of a server farm associated with the lottery office 2. The server farm is illustrated simply for exemplary purposes and is not intended to be limiting. The server farm includes any number of web devices 1 through N, illustrated here as web device 350A and web device 350B. The web devices are connected via the Internet 358 to a hardware load-balancing server 354 through a router 353, firewall 352, and TCP/IP 351. The hardware load-balancing server 354 and a raid disk subsystem 355 is connected to any number of webserver computers, illustrated here as computers 357A-D, via a LAN switch 356.

Figure 29:
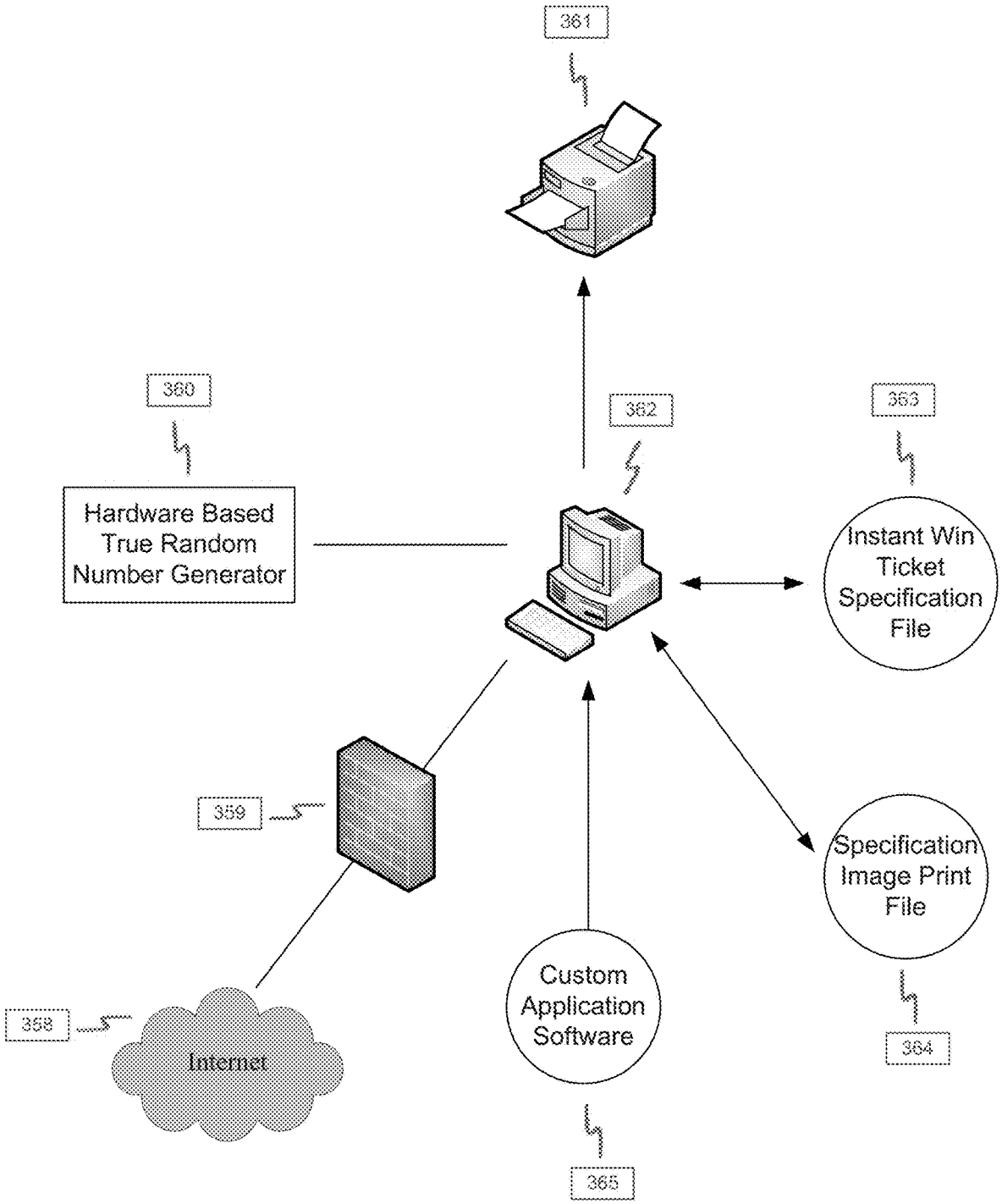
FIG. 29 depicts an example of a specification computer system according to an embodiment of the present invention.

FIG. 29 depicts an example of a specification computer system associated with the game file specification 1. The specification computer system is illustrated simply for exemplary purposes and is not intended to be limiting. A computing system 362 is connected to the Internet 358 through a firewall 359 and a printer 361. The computing system 362 includes a hardware based true random number generator 360, as well as an instant win ticket specification file 363, a specification image print file 364, and custom application software 365.

Figure 30:
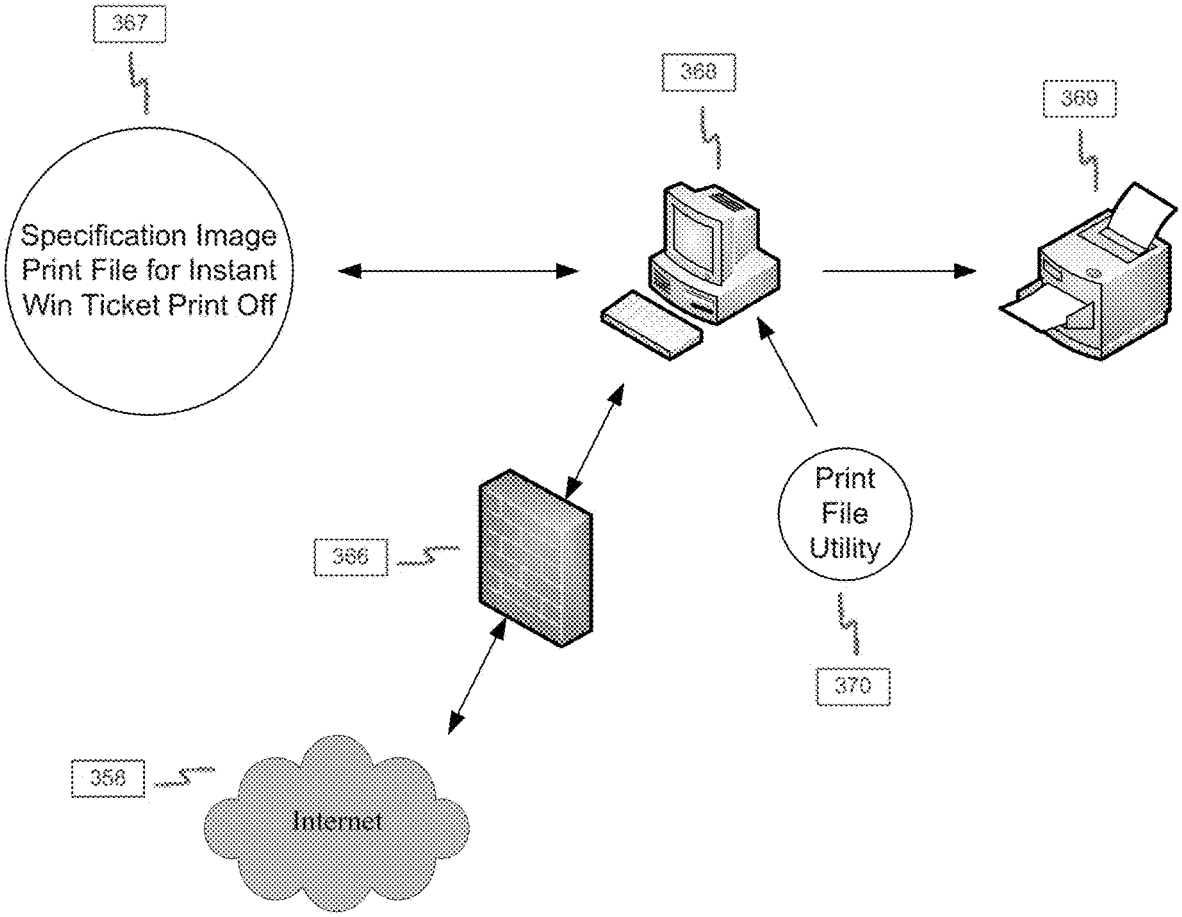
FIG. 30 depicts an example of a printing computer subsystem according to an embodiment of the present invention.

FIG. 30 depicts an example of a printing computer subsystem associated with the printing facility 3. The printing computer subsystem is illustrated simply for exemplary purposes and is not intended to be limiting. A computing system 368 is connected to the Internet 358 through a firewall 366 and a printer 369. The computing system 368 includes a print file utility 370 for receipt of a specification image print file for instant win ticket print off 367.

Figure 17:
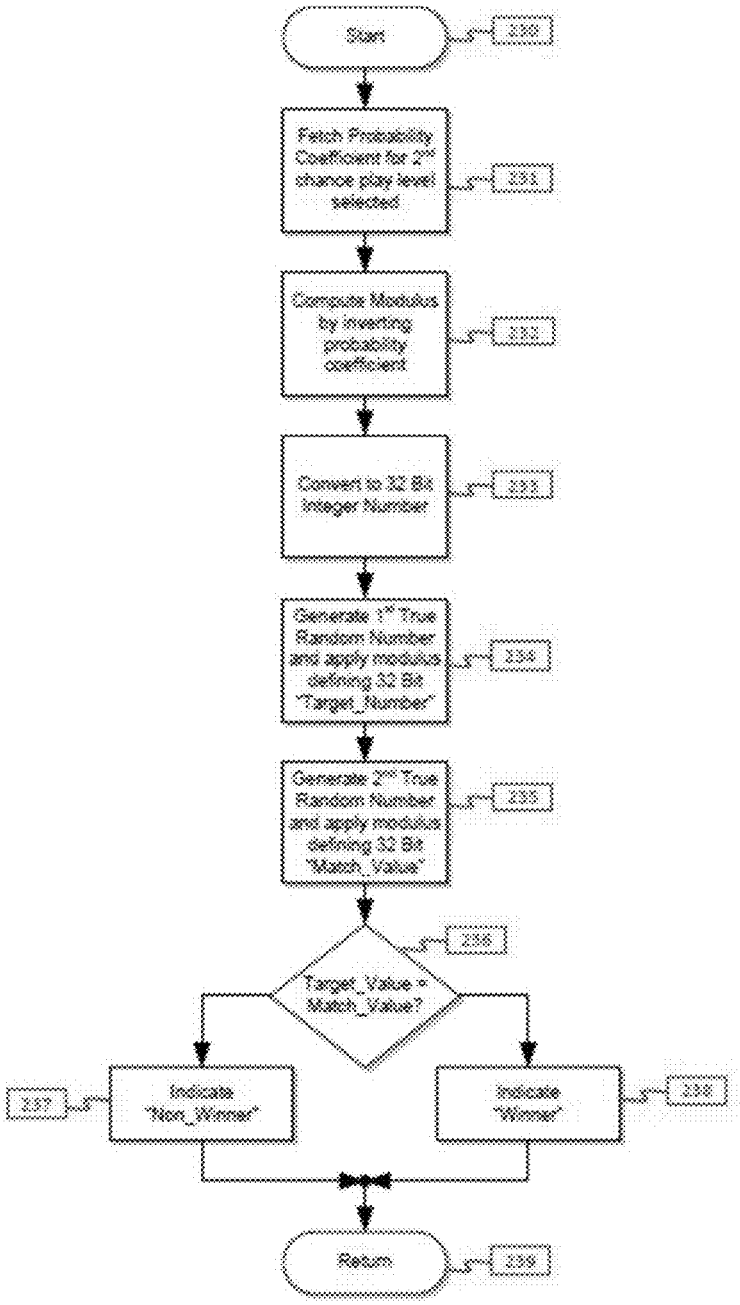
FIG. 17 depicts a flow diagram of random secondary game win determination function according to an embodiment of the present invention.

FIG. 17 is a flow chart of a function to determine an outcome for the secondary game feature. While the function is a preferred embodiment to be incorporated in the secondary game, it is not intended to be a limiting element. Other sources of random number generation can be substituted, whether electrical or mechanical, so long as the probability can be controlled by a modulus function.

Figures 18, 19:
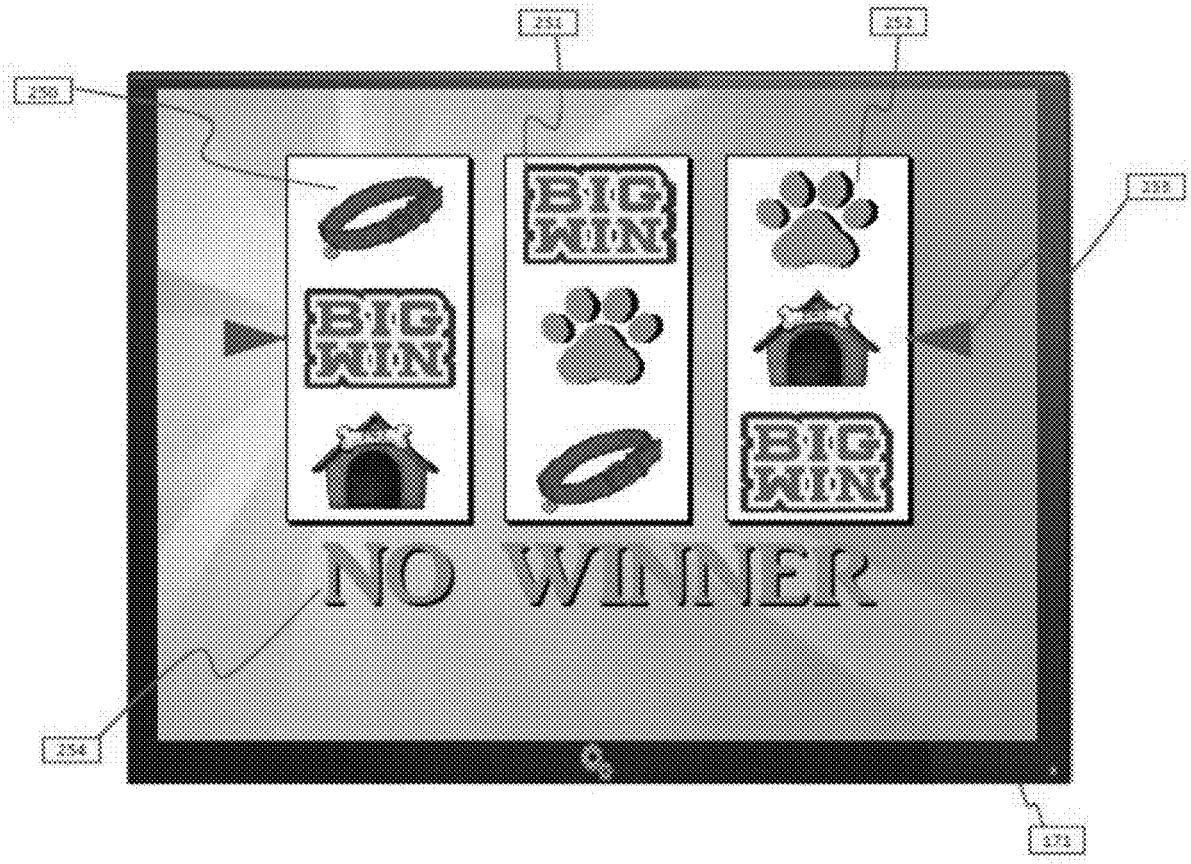
FIG. 18 depicts a secondary game control table according to an embodiment of the present invention.
FIG. 19 depicts an example of a secondary game kiosk with no winner slot variation according to an embodiment of the present invention.

The function is entered at step 230. Step 231 determines the probability coefficient for a win based on a stored table as shown by example in FIG. 18. By example, if the player's ticket indicating an initial win value of $1,000, the probability coefficient is 0.0016. In step 232, the modulus is computed by inverting the probability coefficient, once again with a coefficient of 0.0016; the modulus is 625. Step 233 ensures that the modulus is in a fixed unsigned 32-bit integer format. It should be noted that rather than storing the probability coefficient, the 32-bit modulus can be stored in the secondary game control table as seen in FIG. 18. At step 234 a 32-bit unsigned random integer number is "drawn" from the random number generator 177. This number has the modulus applied to it and is defined as the "target number". In the current example, the random number will be between the values of 0 and 624. In step 235, a second random number is selected with modulus applied. The resulting 32-bit unsigned integer will also be a number between 0 and 624 and defined as the "match value". At step 236, a comparison is made between "target value" and "match value". If they are equal, step 238 occurs and a secondary game win is declared. If "target value" and "match value" are not equal, then step 237 sets the winner status to "no winner". Step 239 returns the win status to the calling routine.

FIG. 18 is an example of a secondary game control table. In this example there are nine prize levels for the secondary game feature for the scratch off ticket game. Level 1 is the grand prize and level 9 is the minimum non-zero prize. The prize amounts are identified for reference purposes with each prize level. The probability of enhancing a non-grand prize is identified as a probability coefficient with each prize level. Although not shown in the example, it may be desired to have a "next level" probability coefficient. By example, going from level 5 to level 4. The reciprocal of the probability coefficients become a modulus value required to compute random number value in the secondary game win determination function. The modulus value for each prize level can optimally be stored in the control table.

Figure 20:
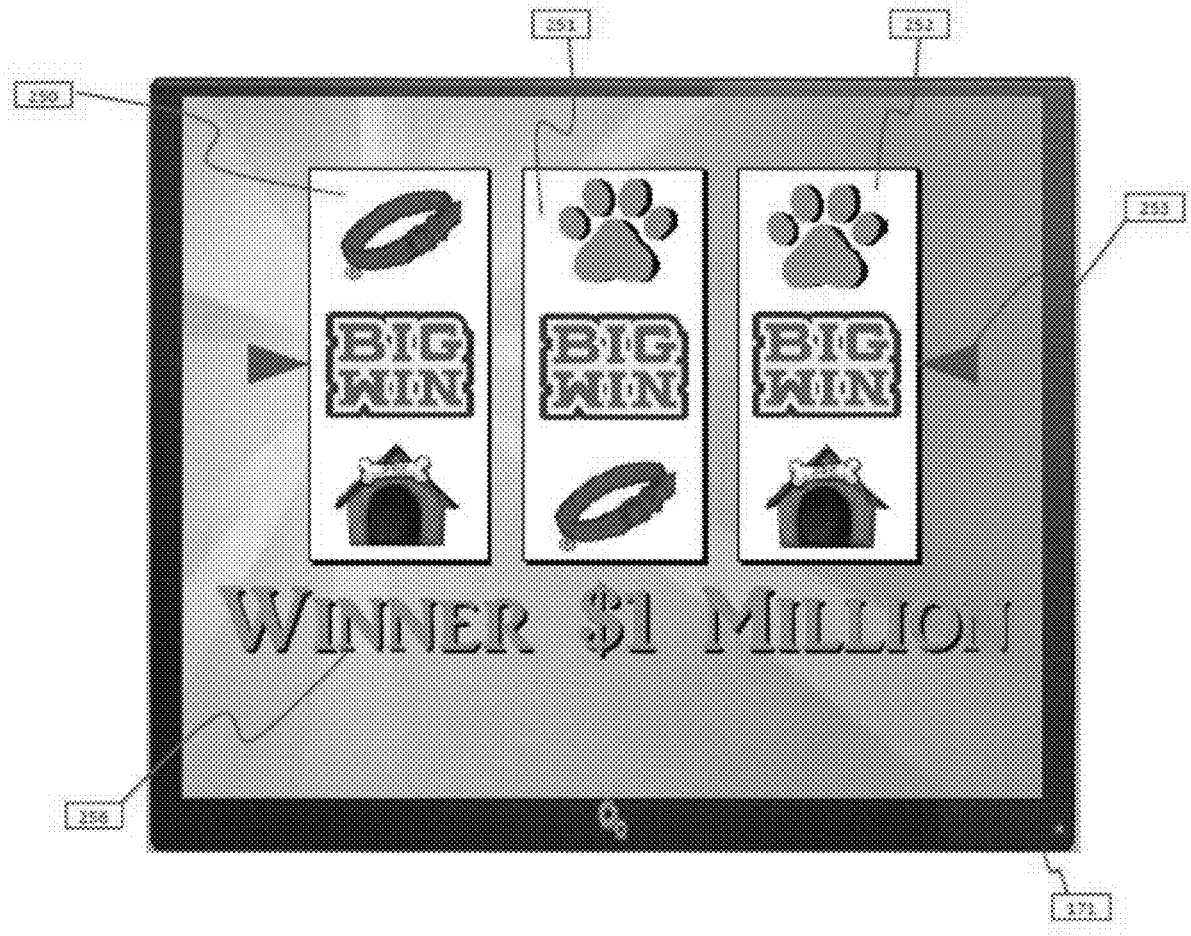
FIG. 20 depicts an example of a secondary game kiosk with winner slot variation according to an embodiment of the present invention.

FIG. 19 is an example of the secondary game implemented as a slot machine, where the player has just pressed the spin button 180 and a "no winner" outcome was determined. The secondary game includes a video slot machine first reel 250, video slot machine second reel 251, a video slot machine third reel 252, a reel stop pointer 253, and a no winner game result 254. FIG. 20 is the secondary game implemented as a slot machine, where the player has just been upgraded to a $1,000,000 winner. Instead of a no winner game result, the secondary game instead shows a one million dollar winner game result 256.

Figure 21:
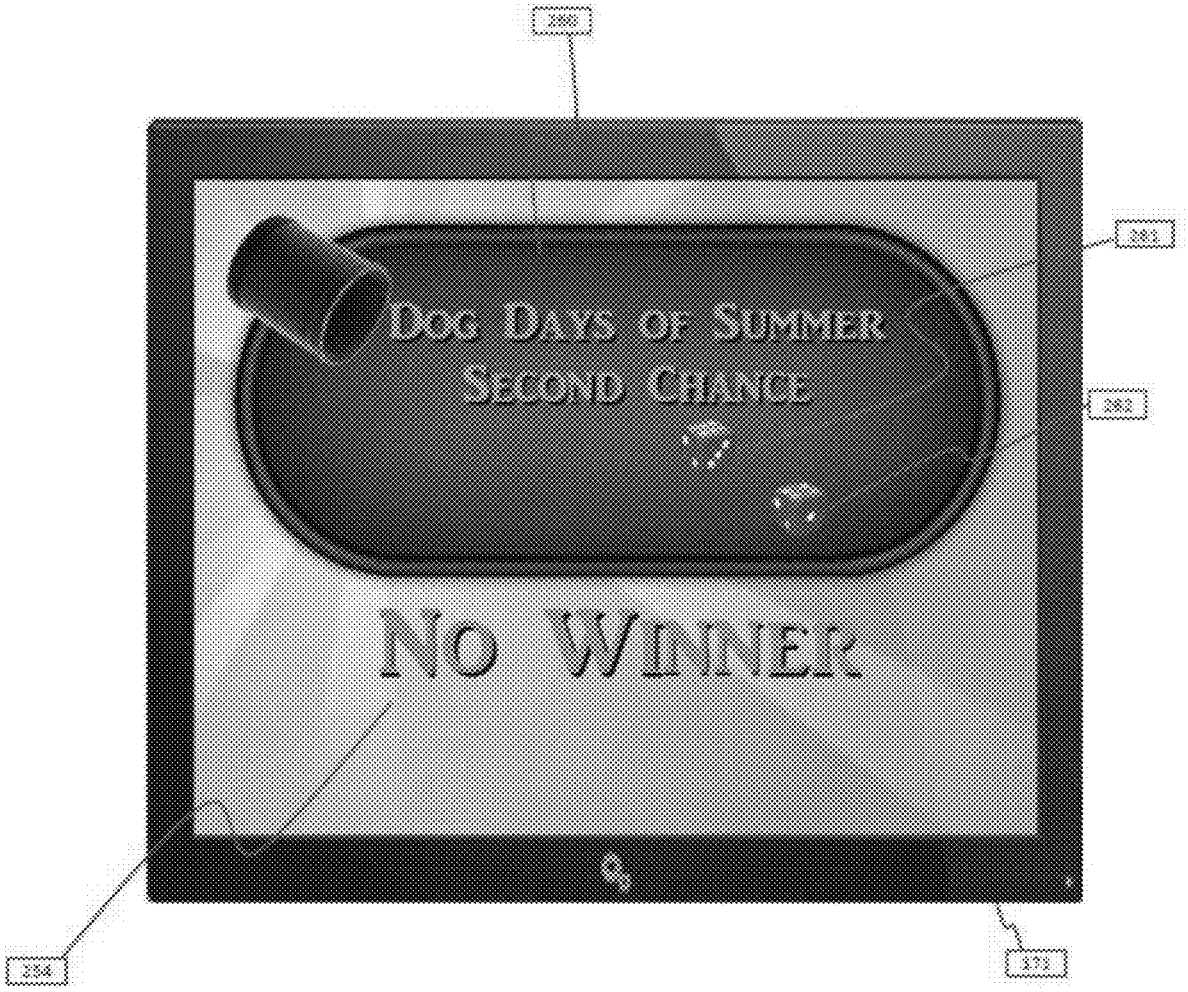
FIG. 21 depicts an example of a secondary game kiosk with no winner dice variation according to an embodiment of the present invention.
Figure 22:
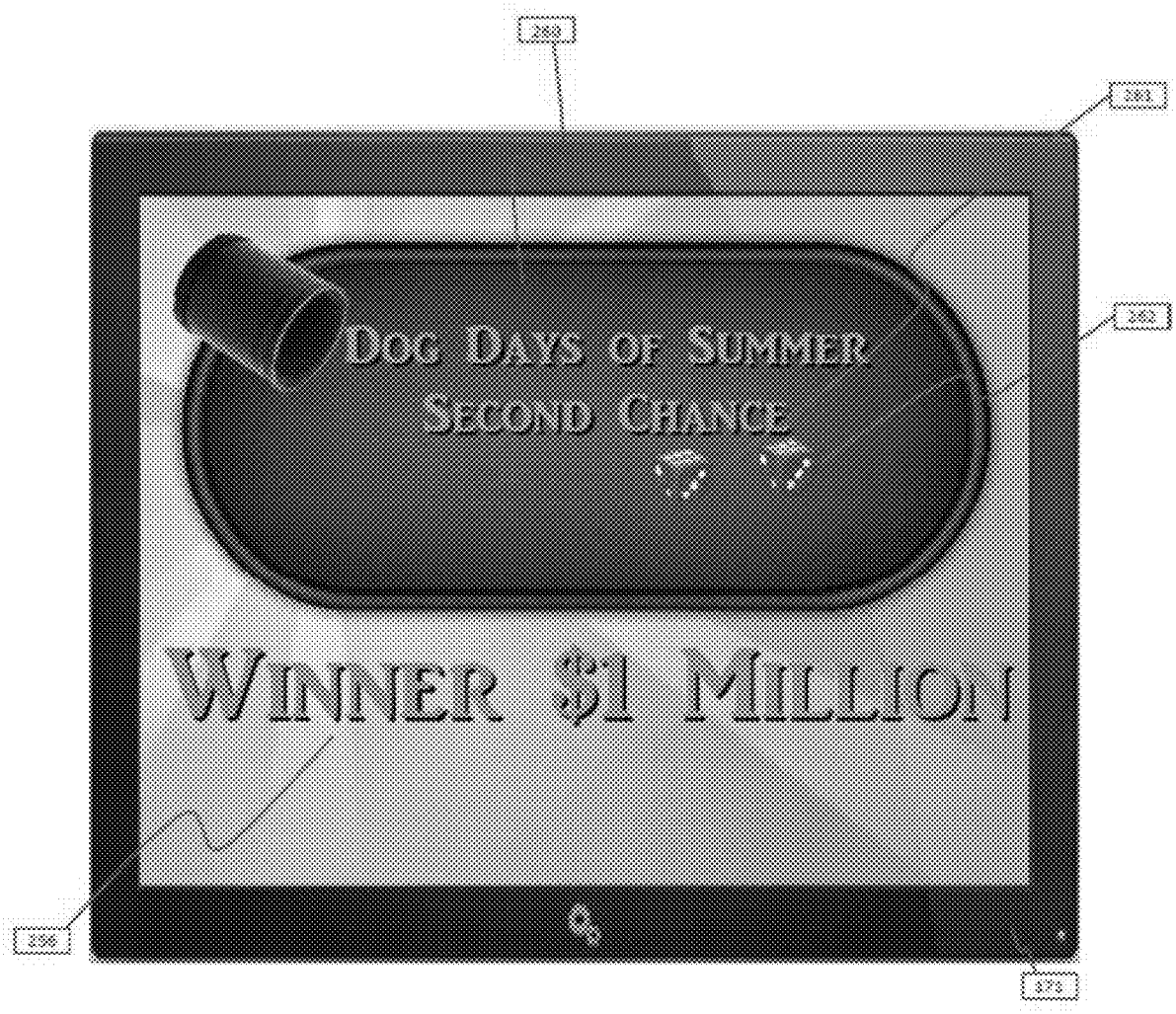
FIG. 22 depicts an example of a secondary game kiosk with winner dice variation according to an embodiment of the present invention.

FIG. 21 is the secondary game implemented as a dice roll (another example of an Bernoulli trial type secondary game). In this example the outcome was a "no winner" due to the fact the dice do not match. The secondary game includes a second chance feature 260, a first die 261, and a second die 262. FIG. 22 is the secondary game where a win has occurred (dice match).

Figure 23:
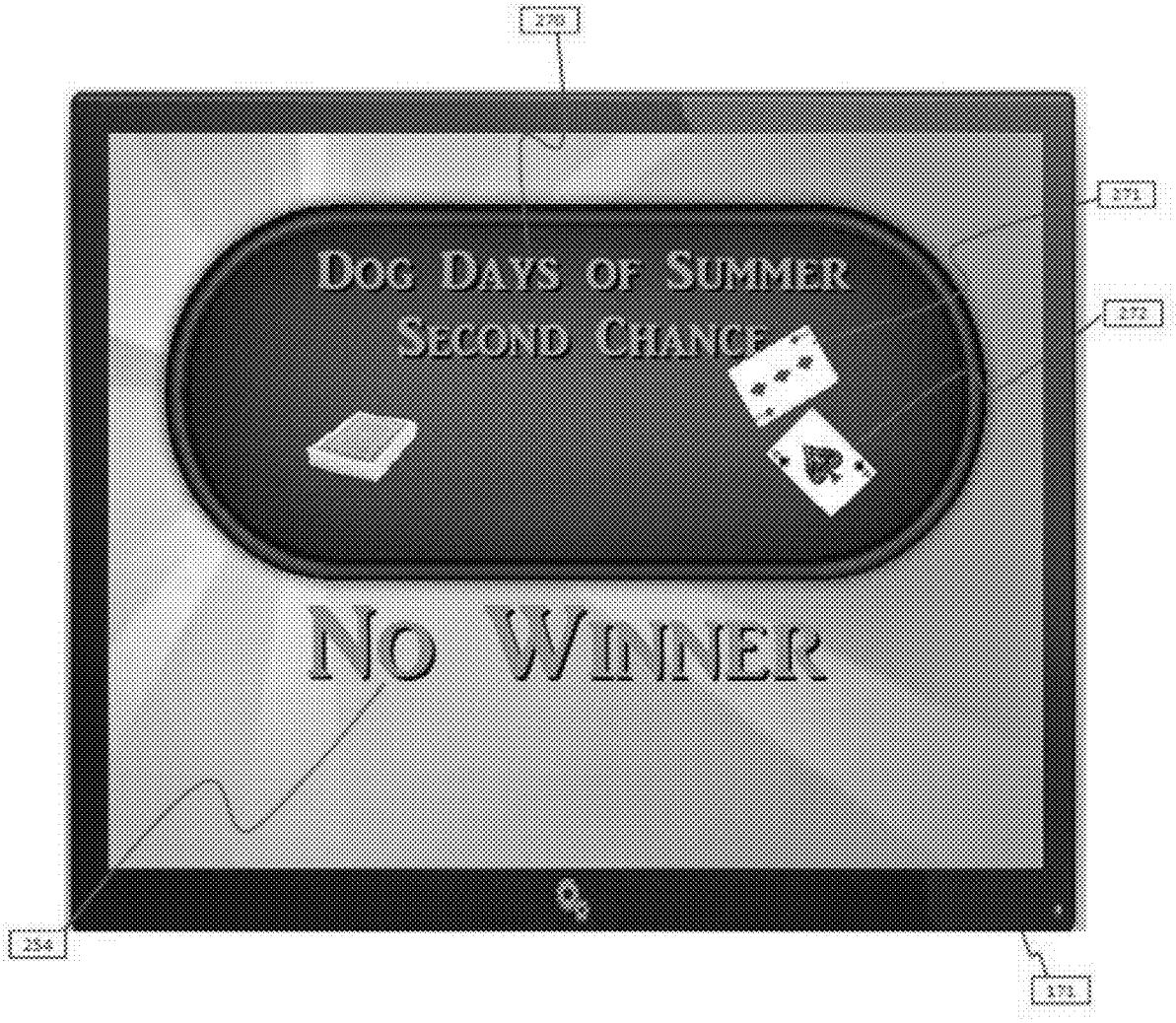
FIG. 23 depicts an example of a secondary game kiosk with no winner card variation according to an embodiment of the present invention.
Figure 24:
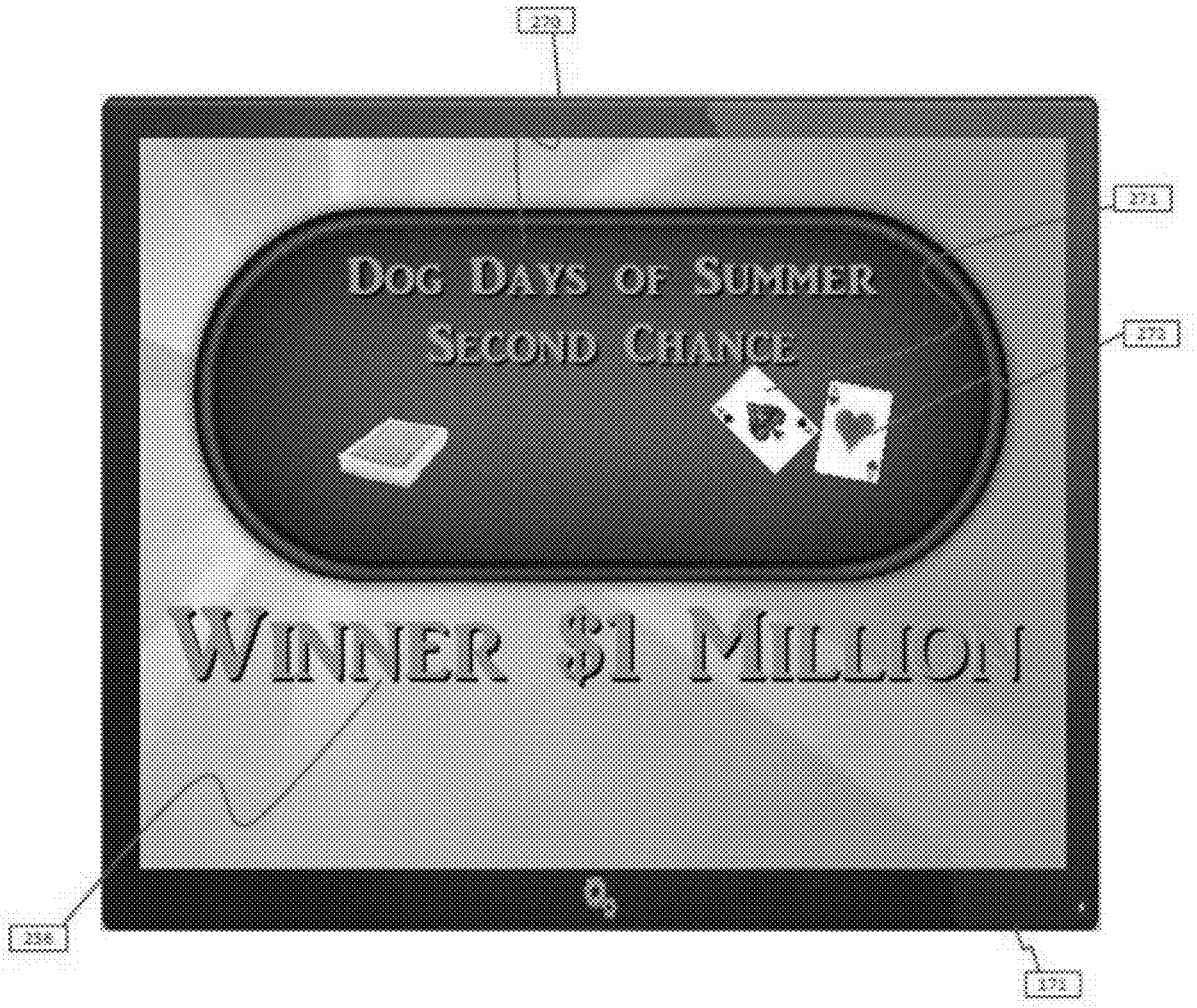
FIG. 24 depicts an example of a secondary game kiosk with winner card variation according to an embodiment of the present invention.

FIG. 23 shows the secondary game implemented as a card draw game. As seen in this example, the cards do not match and a "no winner" outcome has occurred. The secondary game includes a card draw game example (card match by example) 270, a first card 271, and a second card 272. FIG. 24 shows the card draw where the cards match and a "win" has occurred.

FIGS. 19, 20, 21, 22, 23, and 24 illustrate some of the various electronic secondary game variations. The gaming examples are not to be considered a limitation to the overall invention disclosed herein and other gaming variations may be implemented.

In another embodiment, the game player has the opportunity to upgrade their base prize to one of several prizes of a higher value. While a video solution for this embodiment is shown, it should not be considered a limiting factor. The kiosk system utilized in this embodiment includes all components previously described with the exception that the app 175 would be a custom implementation. The app 175 would contain a control table (described below with respect to FIG. 26), which would provide the a priori probabilities for each prize tier above the predetermined prize level or tier required to gain an attempt on the secondary game.

Figures 25, 26:
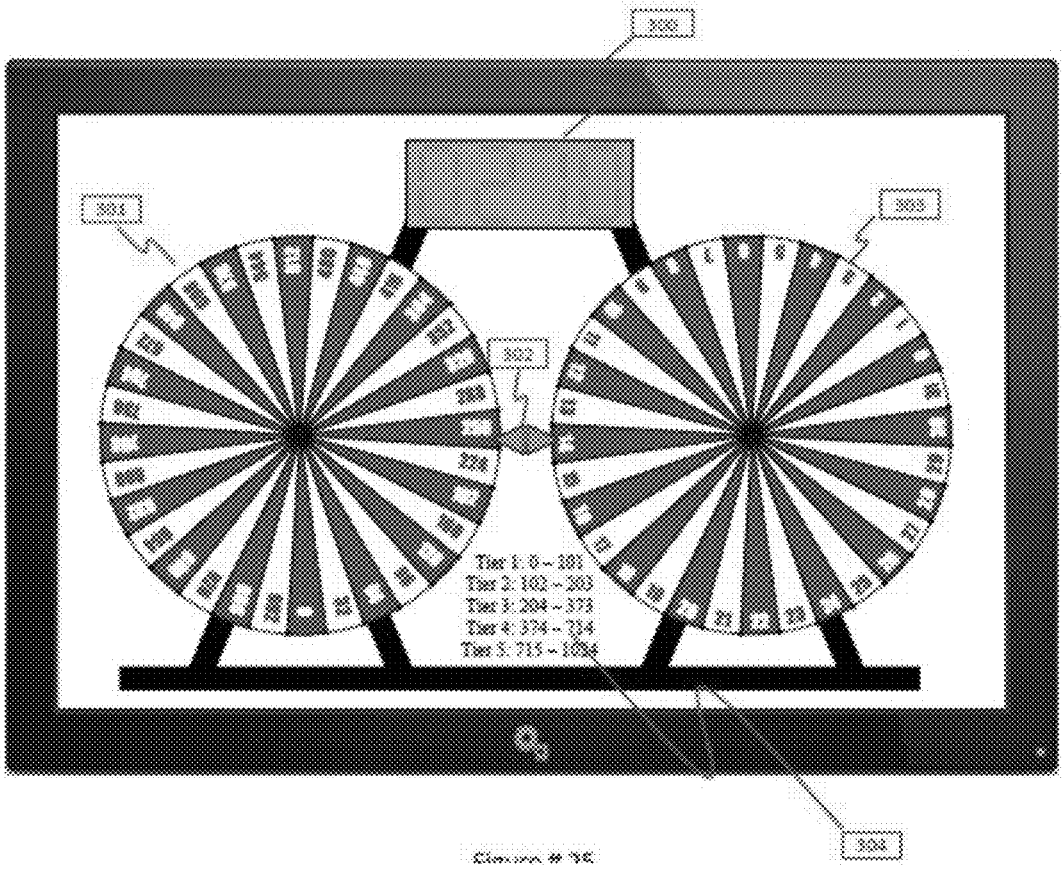
FIG. 25 depicts an example of a secondary game kiosk with double wheel summation variation according to an embodiment of the present invention.
FIG. 26 depicts a conditional secondary game control table according to an embodiment of the present invention.

FIG. 25 depicts an implementation of a preferred embodiment utilizing a "Double Wheel Summation" variation. The wheels 301, 303 are divided equally into 32 areas which allows for 1024 possible outcomes (32×32). The 32 areas on the right wheel 303 are numbered between 0 and 31 incremented by 1. The areas on the left wheel 301 are numbered between 0 and 992 incremented by 32.

FIG. 26 shows an example of the control table which could be utilized in this embodiment. Based on this control table, a Tier 5 prize would need to be revealed on the scratch off instant win lottery ticket 150 for the game player to enter the secondary game. The player will have the opportunity to upgrade their winnings to either $10000, $25000, $100000 or $1 Million. The a priori probabilities of upgrading to the respective prize tiers are 66.67%, 16.67%, 10% and 10%.

Referring back to FIG. 16, when the player presses the spin button 180, the app 175 will interface with Secure RNG 177 to select a number between 1 and 1024. This determines which prize tier will be awarded to the player based on the odds from the control table in FIG. 26. For example, based on the 10% probability of upgrading to Tier 2, if the random number is between 102 and 203 (range equals 1024*0.1), the player's prize will be upgraded to $100,000.

Referring again to FIG. 25, while the table 304 is shown to assist the player in determining their prize, it also reflects the probability ranges used by the app 175. Once the app 175 randomly selects the ending value, it will determine the stop positions of each wheel 301 303 so that the values on each wheel indicated by the pointers 302 will add up to the random value selected. In this example, the app 175 selected via the RNG 177 the value of 270. The app 175 then determined the left wheel 301 would stop on slot 9 with the pointer 302 indicating the value of 256 and the right wheel 303 would stop on slot 15 with the pointer 302 indicating the value of 14. Adding the two values (256 and 14) together, the app 175 would display 0270 in the display area 300. The kiosk 8 computer would use the table 304 to determine 270 is between 204 and 373 indicating they upgraded their winnings to the tier 3 prize, which in this embodiment is $25,000.

Figure 27:
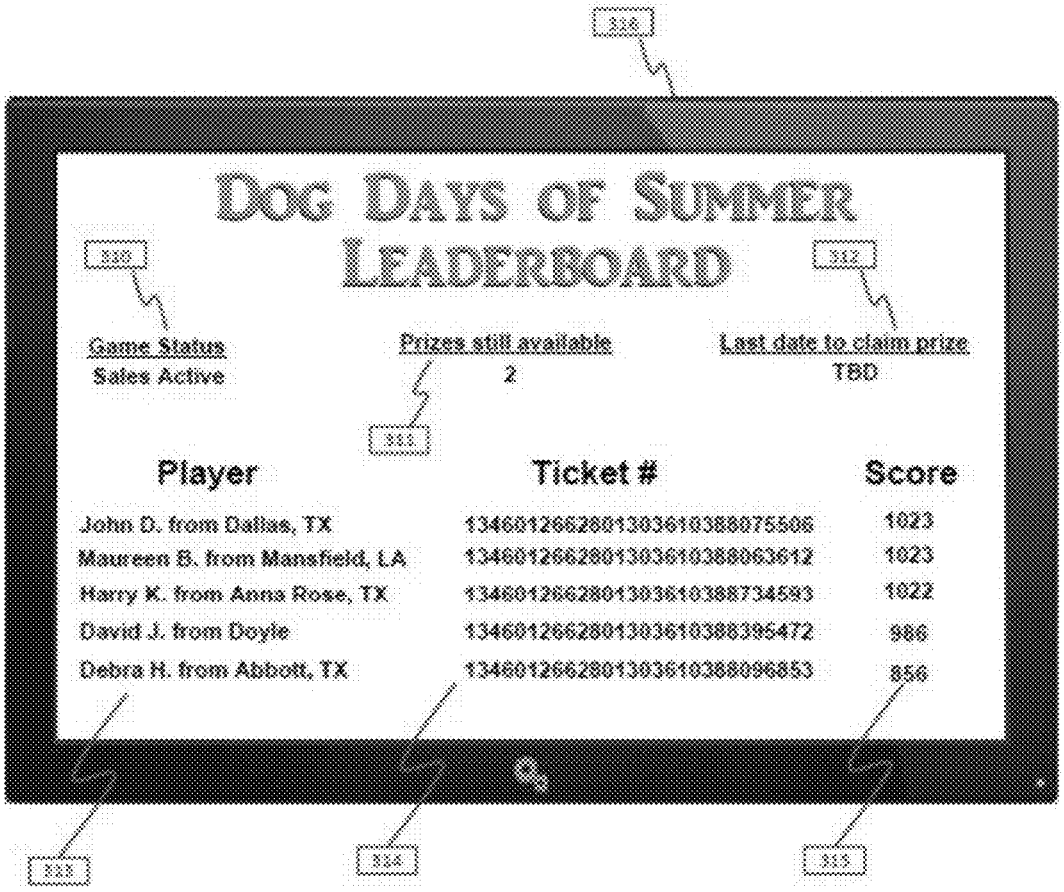
FIG. 27 depicts an example of a conditional secondary game kiosk leaderboard according to an embodiment of the present invention.

FIG. 27 shows a sample of a possible leaderboard feature for the secondary game. A further enhancement that may be offered and would be predefined in the game rules would be the allocation of a minimum number of grand prizes to be awarded by the secondary game. To guarantee a minimum number of wins but not skew the odds, a leaderboard feature could be implemented. The leaderboard 316 is shown implemented as a screen on the secondary game kiosk but it could be implemented as a website style page for remote public viewing. The game status 310 shows that sales of the scratch off instant win tickets is still active. "Sales Ended" and "Game Ended" may be additional statuses of the game. Prizes still available 311 shows there are still two guaranteed tier 1 prizes to win from the secondary game. This also indirectly indicates the leaderboard is still active. If the minimum or guaranteed prizes are all awarded, the leaderboard, depending on the game rules, may be null and void. Last date to claim prize 312 is shown as TBD (To Be Determined).

This is due to the fact that ticket sales are still active. Typically, players have up to one year after the end of ticket sales to claim any prizes won on the scratch ticket and thus claim the chance to play the secondary game. The sample leaderboard shows the top five "non-winning" scores achieved on the secondary game. To provide privacy to the player but to still allow them to follow their standings in the leaderboard, the players first name and last initial and their resident city is shown 313. A unique identifier would be the ticket control number 314 of the scratch off ticket which was read by the optical scanner of the secondary game kiosk. Finally, displayed for each player would be their score achieved in the secondary game 315. If the minimum number of prizes haven't been awarded when the last date to claim prizes has passed, the lottery will issue the grand prize amount to the top player. If there are more than one player with the top score, the lottery may opt for a spin off event until only one player has a top score. The lottery may also issue each player the top prize or divide the top prize equally between the players.

As such, generally disclosed herein is a system and method to increase the operational lifetime of a scratch off ticket instant win lottery game by incorporating a conditional secondary game function. The secondary game function permits lower tier monetary prizes to be converted to upper tier prizes (Grand Prize) using an "A Priori" probabilistic method. Effectively, this adds more grand prizes to the game which can increase the temporal "lifetime" of the instant win game. Increasing the game lifetime will effectively increase the number of tickets sold prior to the game's termination (all grand prizes have been claimed thus concluding the game) and therefore improves the gross income of the game. If eligible for a prize upgrade, the game participant can play a secondary game at an officially sponsored lottery kiosk. In the event there is a "No Win" outcome on the secondary game play, the game participant keeps the original monetary prize awarded by the scratch off ticket and the player enters an extended playoff round supported by a leaderboard tracking system (if available).

It is understood that the above-described embodiments are only illustrative of the application of the principles of the present invention. The present invention may be embodied in other specific forms without departing from its spirit or essential characteristics. All changes that come within the meaning and range of equivalency of the claims are to be embraced within their scope. Thus, while the present invention has been fully described above with particularity and detail in connection with what is presently deemed to be the most practical and preferred embodiment of the invention, it will be apparent to those of ordinary skill in the art that numerous modifications may be made without departing from the principles and concepts of the invention as set forth in the claims.

What is claimed is:

1. A system for increasing the operational lifetime of a scratch-off ticket lottery game where all maximum award amount tickets have been identified by establishing a secondary game with qualified entry, the system comprising:

a computer system configured with a game specification file and at least one random number generator, the computer system programmed based on the game specification file and random number generator to:

randomly generate sequences of characters, each sequence of characters corresponding to one of a winning combination and a losing combination, the winning combinations having different winning award amounts, the losing combinations having a zero winning award amount, at least one sequence of characters corresponding to a winning combination having a maximum award amount;

establish a winning award amount threshold to qualify for entry into a secondary game, the winning award amount threshold being less than the maximum award amount but greater than a lowest winning award amount;

randomly distribute the sequences of characters among a plurality of tickets to be printed for purchase;

wherein a holder of a purchased ticket with a sequence of characters corresponding to a winning combination having a winning award amount less than the maximum winning amount but greater than or equal to the winning award amount threshold qualifies to play the secondary game.

2. The system of claim 1, further comprising a secondary game kiosk having a computer system configured with an application program to implement the secondary game.

3. The system of claim 1, wherein the secondary game comprises one or more of a slot machine, a dice roll, a card draw game, and a double wheel summation game.

4. The system of claim 1, wherein the sequences of characters are randomly generated and distributed via the random number generator based on a Durstenfeld shuffle.

5. The system of claim 1, wherein the secondary game comprises a Bernoulli trial for increasing an initial winning award amount from an initial winning combination.

6. The system of claim 1, wherein the secondary game comprises a scoring system for increasing an initial winning award amount from an initial winning combination.

7. The system of claim 6, wherein the scoring system further comprises a leaderboard system to monitor scores achieved in the secondary game.

8. The system of claim 7, wherein having one or more of the highest positions on the leaderboard system increases the initial winning award amount.

9. A method for increasing the operational lifetime of a scratch-off ticket lottery game where all maximum award amount tickets have been identified by establishing a secondary game with qualified entry, the method comprising:

randomly generating sequences of characters via a random number generator of a computer system, each sequence of characters corresponding to one of a winning combination and a losing combination, the winning combinations having different winning award amounts, the losing combinations having a zero winning award amount, at least one sequence of characters corresponding to a winning combination having a maximum award amount;

establishing a winning award amount threshold to qualify for entry into a secondary game via a game specification file of the computer system, the winning award amount threshold being less than the maximum award amount but greater than a lowest winning award amount;

randomly distributing the sequences of characters via the random number generator among a plurality of tickets to be printed for purchase;

wherein a holder of a purchased ticket with a sequence of characters corresponding to a winning combination having a winning award amount less than the maximum winning amount but greater than or equal to the winning award amount threshold qualifies to play the secondary game.

10. The method of claim 9, wherein the sequences of characters are randomly generated and distributed based on a Durstenfeld shuffle.

11. The method of claim 9, wherein the secondary game comprises a Bernoulli trial for increasing an initial winning award amount from an initial winning combination.

12. The method of claim 9, wherein the secondary game comprises a scoring system for increasing an initial winning award amount from an initial winning combination.

13. The method of claim 12, wherein the scoring system further comprises a leaderboard system to monitor scores achieved in the secondary game.

14. The method of claim 13, wherein having one or more of the highest positions on the leaderboard system increases the initial winning award amount.

15. A non-transitory computer-readable medium having stored thereon a computer program for execution by a processor configured to perform a method for increasing the operational lifetime of a scratch-off ticket lottery game where all maximum award amount tickets have been identified by establishing a secondary game with qualified entry, the method comprising:

randomly generating sequences of characters via a random number generator, each sequence of characters corresponding to one of a winning combination and a losing combination, the winning combinations having different winning award amounts, the losing combinations having zero winning award amount, at least one sequence of characters corresponding to a winning combination having a maximum award amount;

establishing a winning award amount threshold to qualify for entry into a secondary game via a game specification file, the winning award amount threshold being less than the maximum award amount but greater than a lowest winning award amount randomly distributing the sequences of characters via the random number generator among a plurality of tickets to be printed for purchase;

wherein a holder of a purchased ticket with a sequence of characters corresponding to a winning combination having a winning award amount less than the maximum winning amount but greater than or equal to the winning award amount threshold qualifies to play the secondary game.

16. The computer-readable medium of claim 15, wherein the sequences of characters are randomly generated and distributed based on a Durstenfeld shuffle.

17. The computer-readable medium of claim 15, wherein the secondary game comprises a Bernoulli trial for increasing an initial winning award amount from an initial winning combination.

18. The computer-readable medium of claim 15, wherein the secondary game comprises a scoring system for increasing an initial winning award amount from an initial winning combination.

19. The computer-readable medium of claim 18, wherein the scoring system further comprises a leaderboard system to monitor scores achieved in the secondary game.

20. The computer-readable medium of claim 19, wherein having one or more of the highest positions on the leaderboard system increases the initial winning award amount.

* * * * *